US009482084B2

(12) United States Patent
Chang et al.

(10) Patent No.: US 9,482,084 B2
(45) Date of Patent: Nov. 1, 2016

(54) DRILLING ADVISORY SYSTEMS AND METHODS TO FILTER DATA

(71) Applicants: Dar-Lon Chang, Sugar Land, TX (US); Lei Wang, The Woodlands, TX (US); Paul E. Pastusek, The Woodlands, TX (US); Jeffrey R. Bailey, Houston, TX (US); Gregory S. Payette, Houston, TX (US); Darren Pais, Houston, TX (US)

(72) Inventors: Dar-Lon Chang, Sugar Land, TX (US); Lei Wang, The Woodlands, TX (US); Paul E. Pastusek, The Woodlands, TX (US); Jeffrey R. Bailey, Houston, TX (US); Gregory S. Payette, Houston, TX (US); Darren Pais, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 410 days.

(21) Appl. No.: 14/185,833

(22) Filed: Feb. 20, 2014

(65) Prior Publication Data

US 2014/0277752 A1 Sep. 18, 2014

Related U.S. Application Data

(60) Provisional application No. 61/798,631, filed on Mar. 15, 2013.

(51) Int. Cl.

| | |
|---|---|
| ***G01M 1/38*** | (2006.01) |
| ***G06G 7/48*** | (2006.01) |
| ***E21B 25/16*** | (2006.01) |
| ***G01V 1/40*** | (2006.01) |
| ***E21B 44/00*** | (2006.01) |
| ***E21B 45/00*** | (2006.01) |

(52) U.S. Cl.

CPC ..... *E21B 44/00* (2013.01); *E21B 45/00* (2013.01)

(58) Field of Classification Search

CPC ..... E21B 44/00

See application file for complete search history.

(56) References Cited

U.S. PATENT DOCUMENTS

| | | | | |
|---|---|---|---|---|
| 4,507,735 | A | 3/1985 | Moorehead et al. | |
| 4,736,297 | A | 4/1988 | LeJeune | |
| 5,216,917 | A | 6/1993 | Detournay | |
| 5,415,030 | A | 5/1995 | Jogi et al. | |
| 5,551,286 | A | 9/1996 | Booer | |
| 5,663,929 | A | 9/1997 | Pavone et al. | |
| 5,730,234 | A | 3/1998 | Putot | |
| 5,842,149 | A | 11/1998 | Harrell et al. | |
| 5,987,398 | A * | 11/1999 | Halverson ..... | G05B 19/41875 700/275 |
| 6,021,377 | A | 2/2000 | Dubinsky et al. | |

(Continued)

FOREIGN PATENT DOCUMENTS

WO WO 2011/016928 A1 2/2011

OTHER PUBLICATIONS

Chen, Zhe. "Bayesian filtering: From Kalman filters to particle filters, and beyond." Statistics 182.1 (2003): 1-69.*

(Continued)

*Primary Examiner* — James D Rutten

(74) *Attorney, Agent, or Firm* — ExxonMobil Upstream Research Company—Law Department

(57) ABSTRACT

Integrated methods and systems for optimizing drilling related operations include recording data, parsing the data into intervals and analyzing the intervals to determine if the performance data in each time interval is of sufficient quality for using the interval data in a performance optimization process. The quality assessment may involve evaluating the data against a set of determined standards or ranges. The performance optimization process may utilize data mapping and/or modeling to make performance optimization process recommendations.

48 Claims, 12 Drawing Sheets

(56) References Cited

U.S. PATENT DOCUMENTS

| | | | | |
|---|---|---|---|---|
| 6,026,912 | A | 2/2000 | King et al. | |
| 6,155,357 | A | 12/2000 | King et al. | |
| 6,192,998 | B1 | 2/2001 | Pinckard | |
| 6,276,465 | B1 | 8/2001 | Cooley et al. | |
| 6,293,356 | B1 | 9/2001 | King et al. | |
| 6,363,780 | B1 * | 4/2002 | Rey-Fabret | E21B 44/00 175/45 |
| 6,382,331 | B1 | 5/2002 | Pinckard | |
| 6,408,953 | B1 | 6/2002 | Goldman et al. | |
| 6,424,919 | B1 | 7/2002 | Moran et al. | |
| 6,443,242 | B1 | 9/2002 | Newman et al. | |
| 6,480,118 | B1 | 11/2002 | Rao | |
| 6,662,110 | B1 | 12/2003 | Bargach et al. | |
| 6,732,052 | B2 | 5/2004 | Macdonald et al. | |
| 6,785,641 | B1 * | 8/2004 | Huang | E21B 44/00 175/45 |
| 6,820,702 | B2 | 11/2004 | Niedermayr et al. | |
| 6,892,812 | B2 | 5/2005 | Niedermayr et al. | |
| 6,968,909 | B2 | 11/2005 | Aldred et al. | |
| 7,020,597 | B2 | 3/2006 | Oliver et al. | |
| 7,044,238 | B2 | 5/2006 | Hutchinson | |
| 7,044,239 | B2 | 5/2006 | Pinckard et al. | |
| 7,142,986 | B2 | 11/2006 | Moran | |
| 7,172,037 | B2 | 2/2007 | Dashevskiy et al. | |
| 7,261,167 | B2 | 8/2007 | Goldman et al. | |
| 7,274,990 | B2 | 9/2007 | Mathiszik et al. | |
| 7,316,278 | B2 | 1/2008 | Hutchinson | |
| 7,357,196 | B2 | 4/2008 | Goldman et al. | |
| 7,363,988 | B2 | 4/2008 | Jeffryes | |
| 7,412,331 | B2 | 8/2008 | Calhoun et al. | |
| 7,606,666 | B2 | 10/2009 | Repin et al. | |
| 7,610,251 | B2 | 10/2009 | Shayegi et al. | |
| 7,818,128 | B2 | 10/2010 | Zhou et al. | |
| 7,857,047 | B2 | 12/2010 | Remmert et al. | |
| 7,878,268 | B2 | 2/2011 | Chapman et al. | |
| 7,891,420 | B2 | 2/2011 | Dale et al. | |
| 7,896,105 | B2 | 3/2011 | Dupriest | |
| 8,014,987 | B2 | 9/2011 | Pabon et al. | |
| 2002/0104685 | A1 | 8/2002 | Pinckard et al. | |
| 2002/0144842 | A1 * | 10/2002 | Schultz | E21B 12/02 175/39 |
| 2004/0087835 | A1 * | 5/2004 | Hively | A61B 5/4094 600/300 |
| 2004/0256152 | A1 * | 12/2004 | Dashevskiy | E21B 44/00 175/25 |
| 2005/0096847 | A1 | 5/2005 | Huang | |
| 2005/0194185 | A1 * | 9/2005 | Gleitman | E21B 17/003 175/45 |
| 2005/0197777 | A1 | 9/2005 | Rodney et al. | |
| 2008/0082304 | A1 * | 4/2008 | Miller | G05B 17/02 703/9 |
| 2009/0063230 | A1 * | 3/2009 | Broussard | G06Q 10/06313 705/7.23 |
| 2009/0076873 | A1 | 3/2009 | Johnson et al. | |
| 2009/0089227 | A1 | 4/2009 | Sturrock et al. | |
| 2009/0090555 | A1 | 4/2009 | Boone et al. | |
| 2009/0132458 | A1 | 5/2009 | Edwards et al. | |
| 2010/0108384 | A1 | 5/2010 | Byreddy et al. | |
| 2011/0232966 | A1 | 9/2011 | Kyllingstad | |
| 2012/0118637 | A1 | 5/2012 | Wang et al. | |
| 2012/0123756 | A1 | 5/2012 | Wang et al. | |
| 2012/0123757 | A1 | 5/2012 | Ertas et al. | |
| 2013/0066445 | A1 | 3/2013 | Wang et al. | |
| 2013/0066471 | A1 | 3/2013 | Wang et al. | |
| 2013/0105221 | A1 * | 5/2013 | Wassell | E21B 44/04 175/40 |

OTHER PUBLICATIONS

Cheatham, C.A. et al. (1990), "Bit Balling in Water-Reactive Shale During Full-Scale Drilling Rate Tests," SPE 19926, 1990 IADC/SPE Drilling Conf., Houston, TX, Feb. 27-Mar. 2, 1990, pp. 169-178.

Gouda, G. M. et al. (2011), "A Real Mathematical Model to Compute the PDC Cutter Wear Value to Terminate PDC Bit Run," SPE 140151, SPE Middle East Oil & Gas Show & Conf., Manama, Bahrain, Sep. 25-28, 2011, 21 pgs.

Ipek, G. et al. (2006), " Diagnosis of Ineffective Drilling Using Cation Exchange Capacity of Shaly Formations," *Journal of Canadian Petroleum Technology* 45(6), pp. 26-30.

Tucker, R.W. et al. (2000), "An Integrated Model for Drill-String Dynamics," Department of Physics, Lancaster University, pp. 1-7, 32-33, 58-64.

Wang, X. et al. (2005), "Process Monitoring Approach Using Fast Moving Window PCA," *Ind. Eng. Chem. Res.* 44, pp. 5691-5702.

Wold, S. (1987), "Principal Component Analysis," *Chemometrics and Intelligent Laboratory Systems* 2, pp. 37-52.

* cited by examiner

DRILLING ADVISORY SYSTEMS AND METHODS TO FILTER DATA

CROSS REFERENCE TO RELATED APPLICATIONS

This application claims benefit of U.S. Provisional Application No. 61/798,631, filed Mar. 15, 2013. This application is related to U.S. application Ser. No. 13/605,467, filed Sep. 6, 2012 and to U.S. application Ser. No. 13/605,453, filed Sep. 6, 2012, the entirety of all disclosures are incorporated herein.

FIELD

The present disclosure relates generally to systems and methods for improving wellbore drilling related operations. More particularly, the present disclosure relates to systems and methods that may be implemented in cooperation with hydrocarbon-related drilling operations to improve drilling performance.

BACKGROUND

This section is intended to introduce the reader to various aspects of art, which may be associated with embodiments of the present invention. This discussion is believed to be helpful in providing the reader with information to facilitate a better understanding of particular techniques of the present invention. Accordingly, it should be understood that these statements are to be read in this light, and not necessarily as admissions of prior art.

The oil and gas industry incurs substantial operating costs to drill wells in the exploration and development of hydrocarbon resources. The cost of drilling wells may be considered to be a function of time due to the equipment and manpower expenses based on time. The drilling time can be minimized in at least two ways: 1) maximizing the Rate-of-Penetration (ROP) (i.e., the rate at which a drill bit penetrates the earth); and 2) minimizing the non-drilling rig time (e.g., time spent on tripping equipment to replace or repair equipment, constructing the well during drilling, such as to install casing, and/or performing other treatments on the well). Past efforts have attempted to address each of these approaches. For example, drilling equipment is constantly evolving to improve both the longevity of the equipment and the effectiveness of the equipment at promoting a higher ROP. Moreover, various efforts have been made to model and/or control drilling operations to avoid equipment-damaging and/or ROP limiting conditions, such as vibrations, bit-balling, etc.

Many attempts to reduce the costs of drilling operations have focused on increasing ROP. For example, U.S. Pat. Nos. 6,026,912; 6,293,356; and 6,382,331 each provide models and equations for use in increasing the ROP. In the methods disclosed in these patents, the operator collects data regarding a drilling operation and identifies a single control variable that can be varied to increase the rate of penetration. In most examples, the control variable is Weight On Bit (WOB); the relationship between WOB and ROP is modeled; and the WOB is varied to increase the ROP. While these methods may result in an increased ROP at a given point in time, this specific parametric change may not be in the best interest of the overall drilling performance in all circumstances. For example, bit failure and/or other mechanical problems may result from the increased WOB and/or ROP. While an increased ROP can drill further and faster during the active drilling, delays introduced by damaged equipment and equipment trips required to replace and/or repair the equipment can lead to a significantly slower overall drilling performance. Furthermore, other parametric changes, such as a change in the rate of rotation of the drillstring (RPM), may be more advantageous and lead to better drilling performance than simply optimizing along a single variable.

Because drilling performance is measured by more than just the instantaneous ROP, methods such as those discussed in the above-mentioned patents are inherently limited. Other research has shown that drilling rates can be improved by considering the Mechanical Specific Energy (MSE) of the drilling operation and designing a drilling operation that will minimize MSE. For example, U.S. Pat. Nos. 7,857,047, and 7,896,105, each of which is incorporated herein by reference in their entirety for all purposes, disclose methods of calculating and/or monitoring MSE for use in efforts to increase ROP. Specifically, the MSE of the drilling operation over time is used to identify the drilling condition limiting the ROP, often referred to as a "founder limiter". Once the founder limiter has been identified, one or more drilling variables can be changed to overcome the founder limiter and increase the ROP. As one example, the MSE pattern may indicate that bit-balling is limiting the ROP. Various measures may then be taken to clear the cuttings from the bit and improve the ROP, either during the ongoing drilling operation or by tripping and changing equipment.

Recently, additional interest has been generated in utilizing artificial neural networks to optimize the drilling operations, for example U.S. Pat. No. 6,732,052, U.S. Pat. No. 7,142,986, and U.S. Pat. No. 7,172,037. However the limitations of neural network based approaches constrain their further application. For instance, the result accuracy is sensitive to the quality of the training dataset and network structures. Neural network based optimization is limited to local search and has difficulty in processing new or highly variable patterns.

In another example, U.S. Pat. No. 5,842,149 disclosed a close-loop drilling system intended to automatically adjust drilling parameters. However, this system requires a lookup table to provide the relations between ROP and drilling parameters. Therefore, the optimization results depend on the effectiveness of this table and the methods used to generate this data, and consequently, the system may lack adaptability to drilling conditions which are not included in the table. Another limitation is that downhole data is required to perform the optimization.

While these past approaches have provided some improvements to drilling operations, further advances and more adaptable approaches are still needed as hydrocarbon resources are pursued in reservoirs that are harder to reach and as drilling costs continue to increase. Further desired improvements may include expanding the optimization efforts from increasing ROP to optimizing the drilling performance measured by a combination of factors, such as ROP, efficiency, downhole dysfunctions, etc. Additional improvements may include expanding the optimization efforts from iterative control of a single control variable to control of multiple control variables. Moreover, improvements may include developing systems and methods capable of recommending operational changes during ongoing drilling operations.

While such research objectives can be readily appreciated when considered in this light, U.S. Patent Publications 2012/0118637 and 2012/0123756 disclose a data-driven based advisory system. The advisory system uses a PCA (principal component analysis) method to compute the correlations between controllable drilling parameters and an objective function. This objective function can be either a single-variable based performance measurement (MSE, ROP, DOC, or bit friction factor mu) or a mathematical combination of MSE, ROP, and other performance variables such as vibration measurement. Since PCA is based on a local search of a subset of the relevant data in a window of interest (the window can be over an interval of formation depth or over time), the searched results may become trapped at local optimum points (sometimes called stationary points). Therefore, need exists to integrate local search methods such as PCA with global search methods to mitigate this issue. (Global searches are performed on the entire window of relevant data, whereas local searches are performed on subsets of the windowed data.)

Some prior disclosures taught systems and methods that may be generally summarized by the following steps: 1) receiving data regarding drilling parameters wherein one, two, or more of the drilling parameters are controllable; 2) utilizing a statistical model to identify one, two, or more controllable drilling parameters having significant correlation to either an objective function incorporating two or more drilling performance measurements or some other drilling performance measurement; 3) generating operational recommendations for one, two, or more controllable drilling parameters, wherein the operational recommendations are selected to optimize the objective function or the drilling performance measurement, respectively; 4) determining operational updates to at least one controllable drilling parameter based at least in part on the generated operational recommendations; and 5) implementing at least one of the determined operational updates in the ongoing drilling operations.

As wellbore drilling operations progress through an earthen formation, the drill bit axially advances through the formation at a measured rate of penetration, which is commonly calculated as the measured depth drilled over time. As the formation conditions depend on location, depth, and even time, the drilling conditions necessarily change over time and range within a given wellbore or other formation bore. Moreover, the drilling conditions may change in manners that dramatically reduce the efficiencies of the drilling operation and/or that create less preferred operating conditions. Accordingly, research is continually seeking improved methods of predicting and detecting changes in drilling conditions. Some aspects of past research have focused on "local" search based optimization schemes such as neural networks or statistical methods. Since the searched results may be trapped at local optimum points (also called stationary points), these algorithms may not always provide the best solution over a range of drilling depth or time. On the other hand, some empirical methods also have been used to find the "best" drilling parameters within a data window but such methods still cannot determine which direction to change a parameter to find a new set of optimized parameters that will perform better than the previously used parameters.

The presently disclosed and claimed systems and methods provide improvements over these previous paradigms and short-comings. The prior art methods and systems could be further improved by implementing a revised approach for determining whether the data used to make predictions is quality data of flawed data. It is desired to have improved data for which to make operational parameter optimization determinations.

SUMMARY

The present disclosure is directed to exemplary methods and systems for use in drilling a wellbore, such as a wellbore used in hydrocarbon production related operations. Particularly, the disclosure provides an improved process for optimizing one or more controllable drilling operational parameters, which are controllable variables that are associated with drilling the wellbore, so as to improve a system performance property, such as but not limited to rate of penetration.

An exemplary method may include: (a) receiving temporally evolving data from a drilling system while drilling regarding at least two drilling parameters, at least one of which is a controllable drilling operational parameter, the received data corresponding to an interval of drilling time; (b) calculating data-relationship statistics on the temporally evolving received data to identify non-overlapping subintervals of the received data where the subintervals are defined by conditions whereby the received data for the controllable drilling operational parameter of the at least two drilling parameters meets the criteria of having (i) a number of data points within a specified range of number of data points have standard deviations of the controllable drilling operational parameter that is not greater than a specified tolerance for the controllable drilling operational parameter, and (ii) a mean value that is within a specified range for such controllable drilling operational parameter, wherein the subintervals that are defined by such conditions are identified as a response point; (c) cataloging each identified response point within a response database, including cataloging at least one of a property determined from the received data for the identified response point and a corresponding performance value calculated using the received data for the identified response point; (d) locating the cataloged response point for the subinterval within a response map; (e) repeating steps (c)-(d) for each subinterval identified as a response point; and (f) selecting a mapped response point from the response database that meets a selected drilling performance characteristic and using at least one of the recorded properties of and calculated values for the selected response point as a basis for making an operational adjustment for drilling the wellbore. During the course of the drilling operation, data such as WOB, RPM, flow rate, and MSE are collected while drilling.

The invention may include a computer-based system for use in association with drilling operations, the computer-based system comprising: a processor adapted to execute instructions; a non-transitory computer readable storage medium in communication with the processor; and at least one instruction set accessible by the processor and saved in the storage medium; wherein the at least one instruction set is adapted to: receive temporally evolving data from a drilling system while drilling regarding at least two drilling parameters, at least one of which is a controllable drilling operational parameter, the received data corresponding to an interval of drilling time; calculate data-relationship statistics on the temporally evolving received data to identify non-overlapping subintervals of the received data where the subintervals are defined by conditions whereby the received data for the controllable drilling operational parameter of the at least two drilling parameters meets the criteria of having (i) a number of data points within a specified range of number of data points have standard deviations of the controllable drilling operational parameter that is not greater than a specified tolerance for the controllable drilling operational parameter, and (ii) a mean value that is within a specified range for such controllable drilling operational parameter, wherein the subintervals that are defined by such conditions are identified as a response point; catalog each identified response point within a response database, including cataloging at least one of a property determined from the received data for the identified response point and a corresponding performance value calculated using the received data for the identified response point; locate the cataloged response point for the subinterval within a response map; repeating the above steps for each subinterval identified as a response point; and select a mapped response point from the response database that meets a selected drilling performance characteristic and using at least one of the recorded properties of and calculated values for the selected response point as a basis for making an operational adjustment for drilling the wellbore.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, specific aspects and features of the present invention are described in connection with several embodiments. However, to the extent that the following description is specific to a particular embodiment or a particular use of the present techniques, it is intended to be illustrative only and merely provides a concise description of exemplary embodiments. Moreover, in the event that a particular aspect or feature is described in connection with a particular embodiment, such aspects and features may be found and/or implemented with other embodiments of the present invention where appropriate. Accordingly, the invention is not limited to the specific embodiments described below. But rather, the invention includes all alternatives, modifications, and equivalents falling within the scope of the appended claims.

Figure 1:
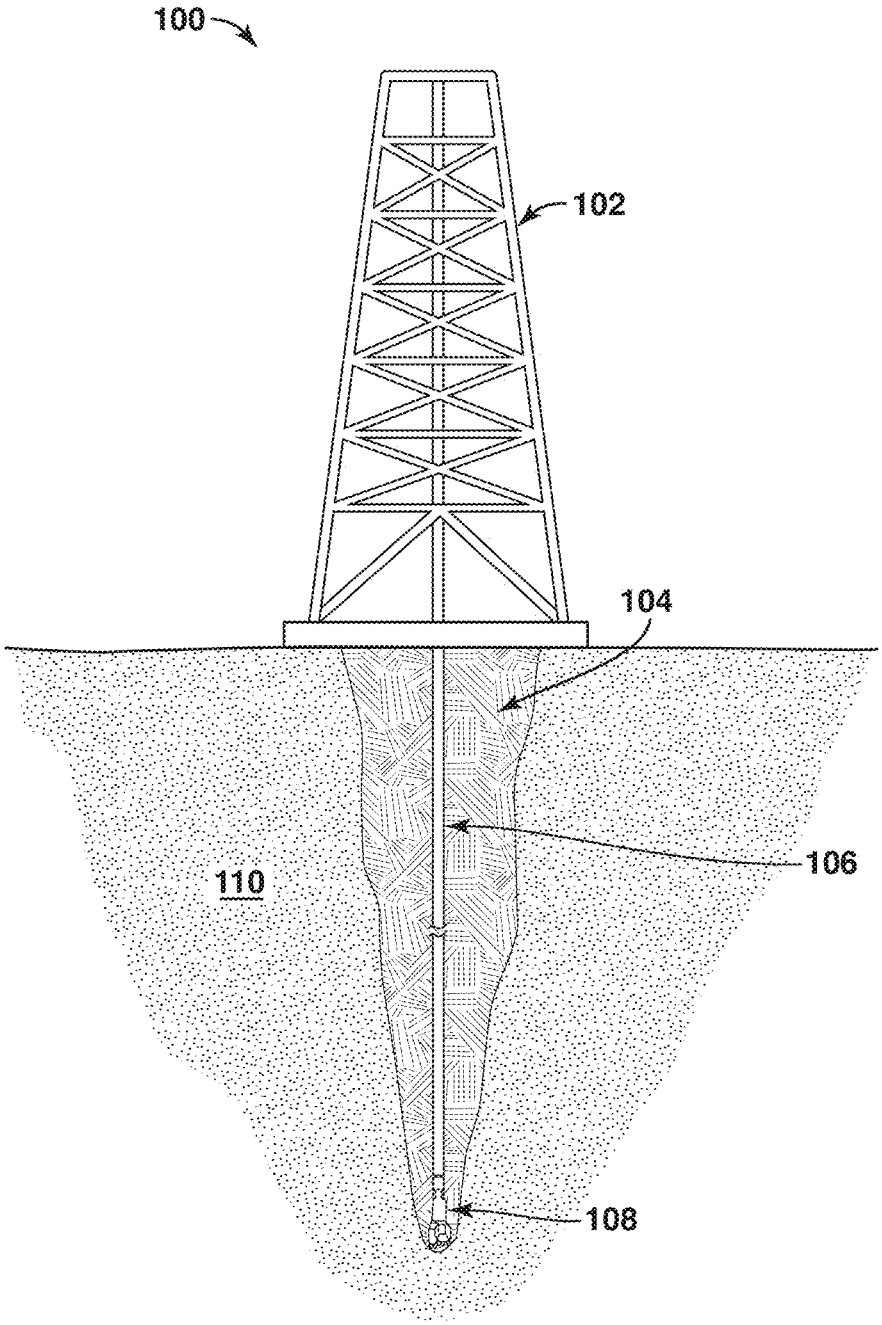
FIG. 1 is a schematic view of a well showing the environment in which the present systems and methods may be implemented.

FIG. 1 illustrates a side view of a relatively generic drilling operation at a drill site 100. FIG. 1 is provided primarily to illustrate the context in which the present systems and methods may be used. As illustrated, the drill site 100 is a land based drill site having a drilling rig 102 disposed above a well 104. The drilling rig 102 includes a drillstring 106 including a drill bit 108 disposed at the end thereof. The apparatus illustrated in FIG. 1 are shown in almost schematic form to show the representative nature thereof. The present systems and methods may be used in connection with any currently available drilling equipment and is expected to be usable with any future developed drilling equipment. Similarly, the present systems and methods are not limited to land based drilling sites but may be used in connection with offshore, deepwater, arctic, and the other various environments in which drilling operations are conducted.

While the present systems and methods may be used in connection with any drilling operation, they are expected to be used primarily in drilling operations related to the recovery of hydrocarbons, such as oil and gas. Additionally, it is noted here that references to drilling operations are intended to be understood expansively. Operators are able to remove rock from a formation using a variety of apparatus and methods, some of which are different from conventional forward drilling into virgin formation. For example, reaming operations, in a variety of implementations, also remove rock from the formation. Accordingly, the discussion herein referring to drilling parameters, drilling performance measurements, etc., refers to parameters, measurements, and performance during any of the variety of operations that cut rock away from the formation. As is well known in the drilling industry, a number of factors affect the efficiency of drilling operations, including factors within the operators' control and factors that are beyond the operators' control. For the purposes of this application, the term drilling conditions will be used to refer generally to the conditions in the wellbore during the drilling operation. The drilling conditions are comprised of a variety of drilling parameters, some of which relate to the environment of the wellbore and/or formation and others that relate to the drilling activity itself. For example, drilling parameters may include rotary speed (RPM), WOB, characteristics of the drill bit and drillstring, mud weight, mud flow rate, lithology of the formation, pore pressure of the formation, torque, pressure, temperature, ROP, MSE, vibration measurements, etc. As can be understood from the list above, some of the drilling parameters are controllable and others are not. Similarly, some may be directly measured and others must be calculated based on one or more other measured parameters.

Figure 2:
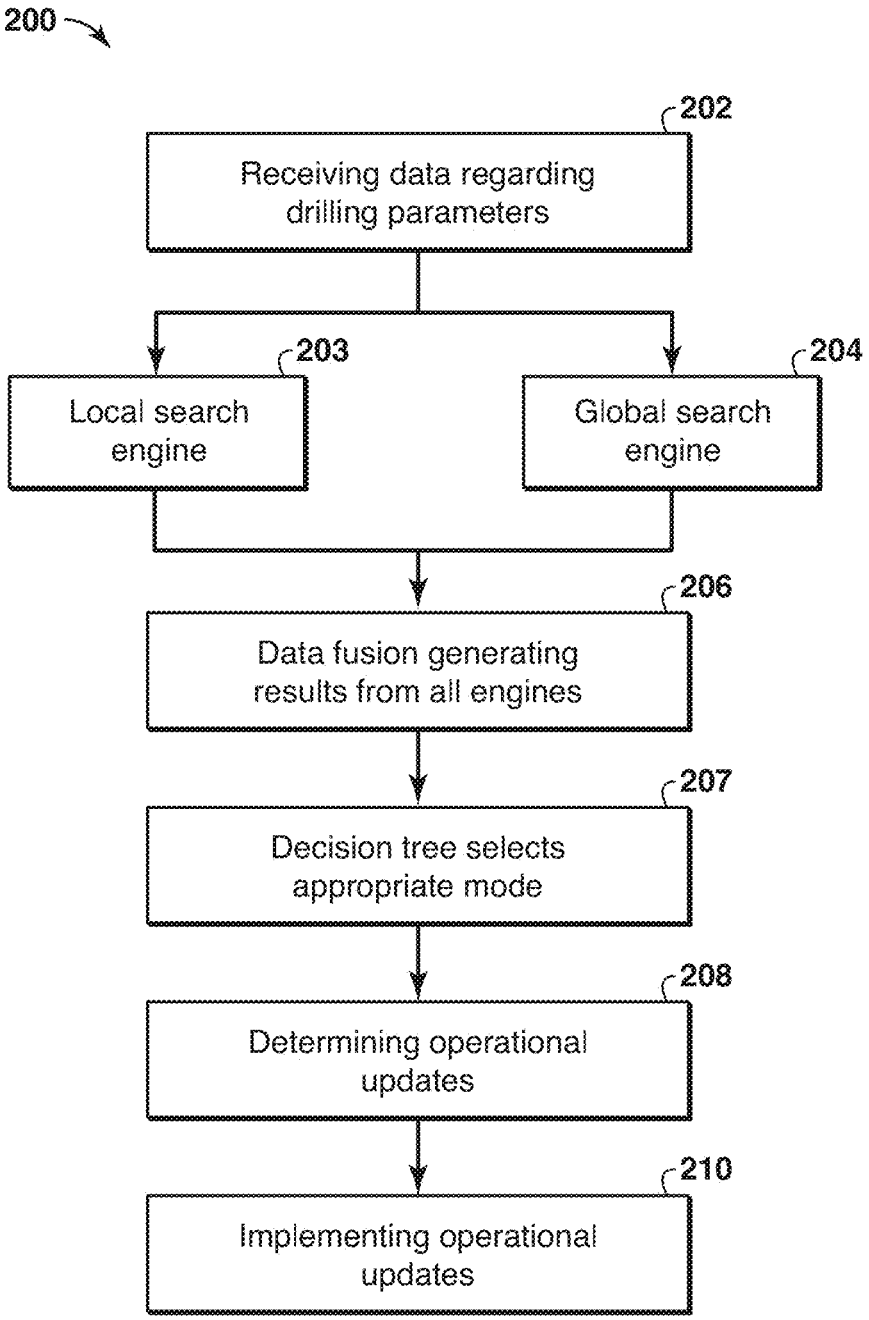
FIG. 2 is a flow chart of methods for updating operational parameters to optimize drilling operations.

As illustrated in FIG. 2, the present invention includes methods of drilling a wellbore 200. FIG. 2 provides an overview of the methods disclosed herein, which will be expanded upon below. In its most simple explanation, the present methods of drilling include: 1) receiving data regarding ongoing drilling operations, specifically data regarding drilling parameters that characterize the drilling operations, at 202; 2) executing a local search engine 203 and a global search engine 204 either in serial or in parallel mode; 3) generating operational recommendations to optimize drilling performance based on a data fusion method, at 206; 4) using a decision tree method to select from the individual global, local, or data fusion results at 207 for application mode, or, alternatively, switching the algorithm to a learning mode, in consideration of a drilling dysfunction map; 5) determining operational updates, at 208; and 6) implementing the operational updates, at 210. The data resulting from conducting drilling operations according to these methods may be collected in response maps, which are collections of one or more response points generated from filtered data that meet prescribed statistical criteria.

The step 202 of receiving data regarding ongoing drilling operations includes receiving data regarding drilling parameters that characterize the ongoing drilling operations. At least one of the drilling parameters received is a controllable drilling parameter, such as RPM, WOB, and mud flow rate. It is to be understood that "receiving drilling parameters" includes all of the means of deriving information about a process parameter. For example, considering the WOB or RPM, the system may record the parameter setpoint provided by the driller using the drilling system controls (or using an automated system to accomplish same), the value may be measured by one or more instruments attached to the equipment, or the data may be processed to achieve a derived or inferred parameter value. For systems that return the measured values of parameters, such as WOB or RPM, the setpoint values may be calculated or inferred from the values recorded by the instrument. In this context, all of these inclusively refer to the "received drilling parameters." The data may be received in any suitable manner using equipment that is currently available or future developed technology. Similarly, the data regarding drilling parameters may come from any suitable source. For example, data regarding some drilling parameters may be appropriately collected from surface instruments while other data may be more appropriately collected from downhole measurement devices.

As one more specific example, data may be received regarding the drill bit rotation rate, an exemplary drilling parameter, either from the surface equipment or from downhole equipment, or from both surface and downhole equipment. The surface equipment may either provide a controlled rotation rate (setpoint, gain, etc.) as an input to the drilling equipment or a measured torque and RPM data, from which downhole bit rotary speed may be estimated. The downhole bit rotation rate can also be measured and/or calculated using one or more downhole tools. Any suitable technology may be used in cooperation with the present systems and methods to provide data regarding any suitable assortment of drilling parameters, provided that the drilling parameters are related to and can be used to characterize ongoing drilling operations and provided that at least one of the drilling parameters is directly or indirectly controllable by an operator.

The data is parsed and analyzed to determine whether the parsed data is of sufficient quality to be useful for assessing the performance and optimization of the drilling system. The quality assessment may involve evaluating the data against a set of determined standards or ranges, while the performance optimization process may utilize data mapping and/or modeling to make performance optimization process recommendations. The data may be filtered to identify sets of contiguously received data points that meet precise statistical requirements for the controllable drilling parameters over a minimum time interval. In one example, the method may require that over an interval of at least 60 seconds the standard deviations of the received drilling parameters (measured drilling values or control setpoints) for WOB, RPM, and flow rate are less than 1,000 pounds, 5 RPM, and 5 gallons per minute, respectively. Whenever this criteria for statistical fidelity is realized, a response point is generated that is assigned the average values of WOB, RPM, and flow rate for the data collected over the course of the 60-second minimum time interval. We further associate an objective function with a given response point. The purpose of the objective function is to provide an appropriate measure of the drilling performance for the given response point. In this example the objective function may be calculated using an ROP-weighted average of the MSE over time, the time-averaged ROP, and the time-averaged value of the Torsional Severity Estimate (TSE), where TSE is a measure of stick-slip severity. A response point is over-written when a new response point has WOB, RPM, and flow rate values within specified tolerances of a previously identified response point values, which are in this example, plus or minus 500 pounds, 2.5 RPM, and 2.5 gallons per minute, respectively, and when the current drilling state parameters are within specified tolerances of the prior values. The response points and response maps are written to storage so that they can be recalled even when they were obtained from data earlier than the current 60 minute moving window of data. Each response point is further identified with a collection of other response points in a response map by common drilling state, within specified tolerances, wherein a drilling state comprises one or more selected drilling parameters.

For each response point, a principle component analysis (PCA) based local search is conducted (using the at least 60 seconds of data used to generate the set point) to find a direction vector (not necessarily a unit vector) associated with the largest improvement in the objective function value. This direction vector is scaled by a user prescribed step size to obtain an average WOB, RPM, and flow rate for a local recommendation associated with the given response point. A "response score" is computed by multiplying the total number of response points in the response point space by five percentage points. If the computed score is greater than 100%, then the score is set to 100%. Since response points are over-written if they are within specified tolerances of a previous response point and are in the same response map, the response score can only be increased by changing the parameters more than the tolerances, and exploring the parameter space beyond the response points already obtained. When the response score reaches 100%, a decision tree is invoked that terminates the learning mode and begins an application mode that produces recommendations based on an average of the local recommendation of the most recent response point, and the WOB, RPM, and flow rate of the response point with the optimum weighted average of the objective function value.

An "objective score" may be calculated by normalizing the objective function value of the most recent response point with the optimum objective function value and multiplying by the response score, with a minimum objective score of zero. Since the maximum response score is 100%, the maximum objective score is also 100% because the normalized objective function value cannot be greater than 100%. If the response score is 100% and the objective score of the most recent response point is less than 40%, for example, an application mode is activated that recommends the driller to adjust the current WOB, RPM, and flow rate to the parameter values of the response point with the optimum objective function value. If the response score is 100% and the objective score is less than 40% for the three most recent response points, a branch of a decision tree is invoked that renders the response map inactive, keeps only the response points within the current moving data window, restores an inactive response map if one exists for a drilling state within tolerance of the current drilling state, and reinstates the learning mode if the response score is now less than 100%. A response map is also rendered inactive if a formation change is detected through a drilling state variable.

A dysfunction map may be used in the response point method to select between multiple learning modes. When a given learning mode is activated by the decision tree, controllable drilling parameters are recommended to be incremented a prescribed amount (for learning purposes). For example, depending upon which region of the dysfunction map is considered active, a branch in the decision tree is used to determine whether and by what amounts the WOB and rotary speed (RPM) are to be either increased or decreased. The branch may also prescribe the order in which the controllable drilling parameters should be changed (e.g., recommendation to change the WOB and then the RPM or vice versa). The collected data points considered by a given branch in the decision tree could be analyzed as individual points, a moving average of points, or as setpoints for each of the controllable parameters, such as WOB, RPM and flow. There are a number of additional ways within multiple decision trees for the learning mode to be activated including but not limited to a detection of a change in response, insufficient data within the parameter ranges of interest, low statistical metrics of the quality of the global, local, or data fusion results, time or footage beyond a defined cutoff, location within a specific regime on a dysfunction map, and combinations of the above.

The decision tree may include a knowledge-based approach. As one example, the field experience may be summarized by an expert system, for which one embodiment may be a lookup table. For example, when drilling is relatively free of dysfunction, i.e. a "good" state, we need to increase the WOB and/or RPM to increase ROP until the inception of dysfunction is detected. For example, the downhole stick-slip state may become severe or exceed a certain threshold. Then we may need to gradually increase RPM or reduce WOB to mitigate the stick-slip but still maintain ROP. Therefore, a what-if lookup table can be developed based on previous field knowledge. While drilling, the four major drilling states (good, whirl, stick-slip, and coupled whirl-stick-slip) can be identified from drilling data either in real-time or near real-time. Then the recommendations for changing drilling parameters can be obtained by checking the lookup table. This is one example of a decision tree.

The present disclosure is further directed to computer-based systems for use in association with drilling operations. Exemplary computer-based systems may include: 1) a processor adapted to execute instructions; 2) a storage medium in communication with the processor; and 3) at least one instruction set accessible by the processor and saved in the storage medium. The at least one instruction set is adapted to perform the methods described herein. For example, the instruction set may be adapted to: 1) receiving temporally evolving data regarding the drilling parameters characterizing wellbore drilling operations while conducting a drilling procedure; 2) storing the temporally evolving data characterizing the wellbore drilling operations; 3) filtering the received data based on statistical methods to identify sets of contiguously received data points associated with intervals of time or depth which have a specified minimum length and further meet prescribed statistical criteria; 4) recording a "response point" for each filtered data set, where a response point is defined as the average(s) or weighted average(s) of at least one received controllable drilling parameter associated with a given filtered data set; 5) determining for a given "response point" the value or values of one or more "objective functions", where each objective function represents an appropriate measure of the performance of the drilling operation associated with the response point; 6) storing a collection of "response points" and their associated objective function values as an "active response map"; 7) adding a new response point to the active response map based on the received data whenever a new filtered data set is identified that meets the requirements of step 3; 8) over-writing a previously determined response point belonging to the active response map with a new response point, in the event that the averaged controllable drilling parameters of the new response point are all within specified tolerances of the corresponding values of the previous response point and the drilling state is within a specified tolerance of the current drilling state; 9) identifying the response point in the response map with the optimum value of the objective function(s); 10) computing a "response score" based on the number of response points comprising the active response map; 11) calculating an "objective score" with the most recent response point objective function value normalized by the optimum value of the objective function and modified by the response score; 12) optionally, using one or more local search engines on each filtered data set or on a subset of windowed data (associated with either a time or depth interval) to compute changes to past or current controllable drilling parameters to improve the objective function value; 13) optionally, using one or more decision trees based on response scores and objective scores to select from multiple learning and application modes of generating operational recommendations for one, two, or more controllable drilling parameters in consideration of a dysfunction map; 14) setting the currently active response map to an inactive mode and activating a new or an inactive response map, depending on whether the drilling state is within a specified tolerance of the drilling state values of an inactive response map and when specified criteria for the response and objective scores are met in the decision trees or, additionally and alternatively, when formation change is detected by changes in one or more "drilling state variables" that characterize drilling through each formation; 15) determining operational updates to at least one controllable drilling parameter based at least in part on the response point methods; and 16) export the generated operational recommendations for consideration in controlling ongoing drilling operations.

The present disclosure is also directed to drilling rigs and other drilling equipment adapted to perform the methods described herein. For example, the present disclosure is directed to a drilling rig system comprising: 1) a communication system adapted to receive data regarding at least two drilling parameters relevant to ongoing wellbore drilling operations; 2) a computer-based system according to the description herein, such as one adapted to perform the methods described herein; and 3) an output system adapted to communicate the generated operational recommendations for consideration in controlling drilling operations. The drilling equipment may further include a control system adapted to determine operational updates based at least in part on the generated operational recommendations and to implement at least one of the determined operational updates during the drilling operation. The control system may be adapted to implement at least one of the determined operational updates at least substantially automatically.

Combined Methods

As indicated above, the methods include, at 203, a local search engine that utilizes a statistical model to identify at least one controllable drilling parameter having significant correlation to an objective function, or one or more objective functions, incorporating two or more drilling performance measurements, such as ROP, MSE, vibration measurements, etc., and mathematical combinations thereof. In some implementations, two or more statistical models may be used in cooperation, synchronously, iteratively, or in other arrangements to identify the significantly correlated and controllable drilling parameters. In some implementations, the statistical model may be utilized in substantially real-time utilizing the received data. Exemplary local search engines may include gradient ascent search, PCA (principal component analysis), Powell's method, etc. The methods also include, at 204, a global search engine to construct the response surface of the selected objective function with respect to controllable drilling parameters in a 3-D surface or a hyperplane in N-dimensional space, by any regression or interpolation methods, and to find an optimal point from the response surface. Note that the local and global engines 203 and 204 may be running in serial and/or parallel mode.

In general terms, both global and local engines search in a hyperdimensional space consisting of one or more drilling parameters and at least one objective function, which incorporates two or more drilling performance measurements and determines the degree of correlation between the objective function and the drilling parameters. By way of example, the objective function may be a single variable of ROP, MSE, Depth of Cut (DOC), bit friction factor mu, and/or mathematical combinations thereof. The objective function may also be a function of ROP, MSE, DOC, mu, weight on bit, drill string parameters, bit rotation rate, torque applied to the drillstring, torque applied to the bit, vibration measurements, hydraulic horsepower (e.g., mud flow rate, viscosity, pressure, etc.) etc., and mathematical combinations thereof. Additional details and examples of utilizing the search engines to identify optimal drilling parameters are provided below.

At 203 and 204, a response point method is applied to process the windowed received drilling parameters for both local and global search engines. The data is filtered to select subsets of consecutive data points, associated with a time or depth interval of minimum length, such that over the course of the interval the controllable drilling parameters are found to be statistically "steady," which means meeting prescribed statistical criteria. An exemplary criterion for statistical steadiness is to require that the standard deviations of WOB, RPM, and flow rate received drilling data within the interval be less than prescribed tolerances. For each filtered data set, a response point is generated, which by definition consists of the average or weighted average of each controllable drilling parameter. For a given response point an objective function value or values is further calculated (using at least one objective function) to produce a well-defined measure of the drilling performance at the response point. A new response point is generated whenever a new set of contiguously received data is identified such that the aforementioned statistical test is satisfied. The response points and associated objective function values and drilling parameter state are further stored as a set referred to as a response map. When a new response point is identified, it is added to the active response map. A previous response point belonging to the response map is over-written when a new response point is identified with controllable drilling parameter values within specified tolerances of the corresponding values of a previous response point, provided that it is within tolerance of the current drilling parameter state. Once removed from the response map, the previous response point can be recorded in a database of historical response points such that it may be restored to the response map at some future point in time of the drilling operation or to enable other statistical processes to be applied to the historical data. In this way, the method provides internal tracking data to conduct performance optimization studies.

Whenever there is a change in the makeup of the active response map, the response point with the optimum value of the objective function is identified (this is the global search of the response point method). A response score is computed based on the number of response points, and an objective score is calculated with the most recent response point objective function value normalized by the optimum objective function value and modified by the response score. One or more local search engines are applied to each filtered data set associated with a particular response point or on a subset of the windowed data to compute changes to past or current controllable drilling parameters to improve the objective function value. Some or all of the response points are removed from the response map whenever specified criteria for the response and/or objective scores are met in the decision tree, again provided that no formation change is detected and that the current drilling parameter state is within tolerance of that for the currently active response map.

Likewise, historical response points may also be restored to the response map in the event that prescribed response and/or objective scores are met in the decision tree. One possible implementation of a response-point based decision tree is that if the objective score associated with three or more consecutive response points is below a prescribed threshold (e.g., 40%), the current active response map is set to inactive mode and stored in the historical database. The historical database may consist of sets of inactive "historical response maps", where each historical map is associated with a "drilling parameter state" or a set of "drilling state variables". Examples of drilling state variables might include (but are not limited to) depth, MSE, TSE, an appropriate lithology measurement or an objective function that combines multiple variables. The drilling state variables may also include ranges of controllable drilling parameters such as WOB, RPM and flow rate. For example, in one field there may be alternating sandstone and shale intervals, the first of which tends to have high stick-slip and high TSE values, and the latter has lower TSE values. The purpose of the drilling state variables is to allow drilling conditions associated with the active response map to be readily compared with drilling conditions of each of the inactive historical response maps. This mode of comparing the current drilling states with historical drilling states can be used to restore an inactive response map in the event that current and historical drilling states are found to be approximately similar. Examples of criteria for drilling state variables that can be used to trigger restoration of historical response points are predicted depths of formation change from a geological forecast and a range of objective function values associated with a historical response map. Each historical response map may represent a different geological formation, and restoring the response points of an inactive historical response map is useful when drilling through laminated, alternating formations. Other drilling conditions may provide different situations for which this method offers certain advantages by retaining information from prior drilling data.

Basically, the local and global search engines generate recommendations separately for the controllable drilling parameters in serial and/or parallel mode. Then at 206, a method is used to fuse the recommendations from the two engines or select between the two engines based on whether specified criteria are met for the response score and objective score. The embodiments of the data fusion method may include using weighted averaging, power-law averaging, Murphy's averaging, fuzzy logic, Dempster-Shafer (D-S) Evidence, Kalman filter, and Bayesian networks. Furthermore, the method of combining the search results using data fusion may change with time and with changes in the drilling parameter values. At 207, a response point-based decision tree is used to select an application mode or a learning mode, based on whether specified criteria are met for the response score and objective score. When a learning mode is activated, the recommendations can be based on principles such as increasing WOB, RPM, and/or flow rate until an objective function no longer improves. The recommendation for WOB, RPM, or flow rate is increased in specified step sizes as long as the objective function is improved. Once the objective function stops improving, the recommendation for a different drilling parameter is increased. If all drilling parameters have been increased and the objective function is no longer improving, recommendations for decreasing each drilling parameter from the lowest value of a response point begin until an application mode is triggered and learning mode ends. Compared to the traditional drilling optimization methods, such as statistical methods or neural networks, the main benefit of using response point-based decision trees to select from multiple global and local search engines is that response points filter and average the data to consider only data that are the least influenced by transients, noise, and dynamic factors such as bit wear and formation change.

In some implementations, the response-point based decision tree recommendations may provide qualitative recommendations, such as increase, decrease, or maintain a given drilling parameter (e.g., weight on bit, rotation rate, etc.), or the recommendation might be to pick up off bottom. Additionally or alternatively, the recommendations may provide quantitative recommendations, such as to increase a drilling parameter by a particular measure or percentage or to decrease a drilling parameter to a particular value or range of values. In some implementations, the operational recommendations may be subject to boundary limits, such as maximum rate of rotation, minimum acceptable mud flow rate, top-drive torque limits, maximum duration of a specified level of vibrations, etc., that represent either physical equipment limits or limits derived by consideration of other operational aspects of the drilling process. For example, there may be a minimum acceptable mud flow rate to transport drill cuttings to the surface and/or a maximum acceptable rate above which the equivalent circulating density becomes too high. In the decision tree method, the data fusion results may be accepted or rejected (application mode), or an alternative path may be selected based on other information, such as selection of a learning mode.

Continuing with the discussion of FIG. 2, the step of determining operational updates, at 208, includes determining operational updates to at least one controllable drilling parameter, which determined operational updates are based at least in part on the generated operational recommendations. Similar to the generation of operational recommendations and as will be discussed in greater detail below, the determined operational update for a given drilling parameter may include directional updates and/or quantified updates. For example, the determined operational update for a given drilling parameter may be selected from increase/decrease/maintain/pickup commands or may quantify the degree to which the drilling parameter should be changed, such as increasing or decreasing the weight on bit by X and increasing or decreasing the rotation rate by Y.

The step of determining operational updates may be performed by one or more operators (i.e., individuals at the rig site or in communication with the drilling operation) and computer-based systems. For example, drilling equipment is being more and more automated and some implementations may be adapted to consider the operational recommendations alone or together with other data or information and determine operational updates to one or more drilling parameters. Additionally or alternatively, the drilling equipment and computer-based systems associated with the present methods may be adapted to present the operational recommendations to a user, such as an operator, who determines the operational updates based at least in part on the operational recommendations. The user may determine the operational updates based at least in part on the operational recommendations using "hog laws" or other experienced based methods and/or by using computer-based systems.

Finally, the step of implementing at least one of the determined operational updates in the ongoing drilling operation, at 210, may include modifying and/or maintaining at least one aspect of the ongoing drilling operations based at least in part on the determined operational updates. In some implementations, such as when the operational updates are determined by computer-based systems from the operational recommendations, the implementation of the operational updates may be automated to occur without user intervention or approval. Additionally or alternatively, the operational updates determined by a computer-based system may be presented to a user for consideration and approval before implementation. For example, the user may be presented with a visual display of the proposed determined operational updates, which the user can accept in whole or in part without substantial steps between the presentation and the implementation. For example, the proposed updates may be presented with 'accept' and 'change' command buttons or controls and with 'accept all' functionality. In such implementations, the implementation of the determined operational updates may be understood to be substantially automatic as the user is not required to perform calculations or modeling to determine the operational update or to perform several manual steps to effect the implementation. Additionally or alternatively, the implementation of the determined operational updates may be effected by a user after a user or other operator has considered the operational recommendations and determined the operational updates.

While specific examples of implementations within the scope of the above described method and within the scope of the claims are described below, it is believed that the description provided above and in connection with FIG. 2 illustrates at least one improvement over the paradigms of the previous efforts. Specifically, it consists of global and local search engines calculating recommended parameters and use of a data fusion module to combine the recommendations from multiple search engines, followed by a decision tree method to accept or reject these results and choose between learning and application modes, based in part on the knowledge of a drilling dysfunction map. This new approach can mitigate the issue that recommendation results may be trapped at a local minimum point of the response surface. This is a common issue for many local search based optimization methods such as neural networks and gradient search methods. Typically, the inclusion of a global search method also provides a search over a wider parameter set than a local search method. Compared to some common empirical optimization methods, this new approach also offers more adaptability to the input data stream.

Although reference herein is to using a global and a local search engine, more generally the data fusion method could use more than one search engine of each type. The data fusion algorithm would then be adjusted to combine the results in such a way as to provide the most optimum results based on some measure of drilling criteria, statistical significance, or a combination of the drilling and statistical methods.

Figure 3:
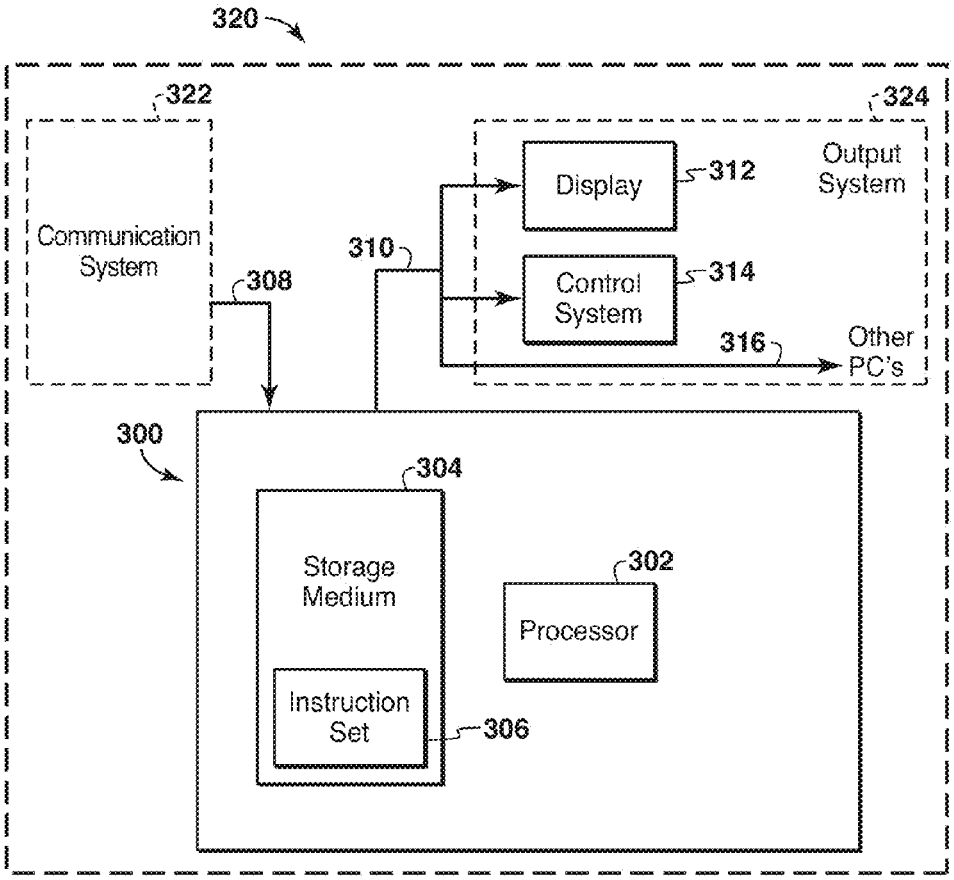
FIG. 3 is a schematic view of systems within the scope of the present invention.

FIG. 3 schematically illustrates systems within the scope of the present invention. In some implementations, the systems comprise a computer-based system 300 for use in association with drilling operations. The computer-based system may be a computer system, may be a network-based computing system, and/or may be a computer integrated into equipment at the drilling site. The computer-based system 300 comprises a processor 302, a storage medium 304, and at least one instruction set 306. The processor 302 is adapted to execute instructions and may include one or more processors now known or future developed that is commonly used in computing systems. The storage medium 304 is adapted to communicate with the processor 302 and to store data and other information, including the at least one instruction set 306. The storage medium 304 may include various forms of electronic storage mediums, including one or more storage mediums in communication in any suitable manner. The selection of appropriate processor(s) and storage medium(s) and their relationship to each other may be dependent on the particular implementation. For example, some implementations may utilize multiple processors and an instruction set adapted to utilize the multiple processors so as to increase the speed of the computing steps. Additionally or alternatively, some implementations may be based on a sufficient quantity or diversity of data that multiple storage mediums are desired or storage mediums of particular configurations are desired. Still additionally or alternatively, one or more of the components of the computer-based system may be located remotely from the other components and be connected via any suitable electronic communications system. For example, some implementations of the present systems and methods may refer to historical data from other wells, which may be obtained in some implementations from a centralized server connected via networking technology. One of ordinary skill in the art will be able to select and configure the basic computing components to form the computer-based system.

Importantly, the computer-based system 300 of FIG. 3 is more than a processor 302 and a storage medium 304. The computer-based system 300 of the present disclosure further includes at least one instruction set 306 accessible by the processor and saved in the storage medium. The at least one instruction set 306 is adapted to perform the methods of FIG. 2 as described above and/or as described below. As illustrated, the computer-based system 300 receives data at data input 308 and exports data at data export 310. The data input and output ports can be serial port (DB-9 RS232), LAN or wireless network, etc. The at least one instruction set 306 is adapted to export the generated operational recommendations for consideration in controlling drilling operations. In some implementations, the generated operational recommendations may be exported to a display 312 for consideration by a user, such as a driller. In other implementations, the generated operational recommendations may be provided as an audible signal, such as up or down chimes of different characteristics to signal a recommended increase or decrease of WOB, RPM, or some other drilling parameter. In a modern drilling system, the driller is tasked with monitoring of onscreen indicators, and audible indicators, alone or in conjunction with visual representations, may be an effective method to convey the generated recommendations. The audible indicators may be provided in any suitable format, including chimes, bells, tones, verbalized commands, etc. Verbal commands, such as by computer generated voices, are readily implemented using modern technologies and may be an effective way of ensuring that the right message is heard by the driller. Additionally or alternatively, the generated operational recommendations may be exported to a control system 314 adapted to determine at least one operational update. The control system 314 may be integrated into the computer-based system or may be a separate component. Additionally or alternatively, the control system 314 may be adapted to implement at least one of the determined updates during the drilling operation, automatically, substantially automatically, or upon user activation.

Continuing with the discussion of FIG. 3, some implementations of the present technologies may include drilling rig systems or components of the drilling rig system. For example, the present systems may include a drilling rig system 320 that includes the computer-based system 300 described herein. The drilling rig system 320 of the present disclosure may include a communication system 322 and an output system 324. The communication system 322 may be adapted to receive data regarding at least two drilling parameters relevant to ongoing drilling operations. The output system 324 may be adapted to communicate the generated operational recommendations and/or the determined operational updates for consideration in controlling drilling operations. The communication system 322 may receive data from other parts of an oil field, from the rig and/or wellbore, and/or from another networked data source, such as the Internet. The output system 324 may be adapted to include displays 312, printers, control systems 314, other computers 316, network at the rig site, or other means of exporting the generated operational recommendations and/or the determined operational updates. The other computers 316 may be located at the rig or in remote offices. In some implementations, the control system 314 may be adapted to implement at least one of the determined operational updates at least substantially automatically. As described above, the present methods and systems may be implemented in any variety of drilling operations. Accordingly, drilling rig systems adapted to implement the methods described herein to optimize drilling performance are within the scope of the present invention. For example, various steps of the presently disclosed methods may be done utilizing computer-based systems and algorithms and the results of the presently disclosed methods may be presented to a user for consideration via one or more visual displays, such as monitors, printers, etc., or via audible prompts, as described above. Accordingly, drilling equipment including or communicating with computer-based systems adapted to perform the presently described methods are within the scope of the present invention.

Objective Functions

As described above in connection with FIG. 2, the present systems and methods optimize an objective function incorporating two or more drilling performance measurements by determining relationships between one or more controllable drilling parameters and the objective function (or, more precisely, the mathematical combination of the two or more drilling performance measurements). In some implementations, the two or more drilling performance measurements may be embodied in one or more objective functions adapted to describe or model the performance measurement in terms of at least two controllable drilling parameters. As described herein, relating the objective function to at least two controllable drilling parameters may provide additional benefits in the pursuit of an optimized drilling operation. As shown in equation (1), an objective function can be solely based on ROP, MSE, or DOC and is referenced at times herein to illustrate one or more of the differences between the present systems and methods and the conventional methods that merely seek to maximize ROP. Exemplary objective functions within the scope of the present invention are shown in equations (2) and (3). As shown, the objective function may be a function of two or more drilling performance measurements (e.g., ROP and/or MSE) and/or may be a function of controllable and measurable parameters. It is understood that the drilling parameters to be included in the objective functions include the setpoint values, measured values, or processed measured values to derive or infer setpoint values.

$$\text{OBJ}=\text{ROP} \tag{1.1}$$

$$\text{OBJ}=F(\text{MSE}) \tag{1.2}$$

where F is a mathematical function such as F(x)=−(x) or F=1/(x).

$$OBJ = DOC = k\frac{ROP}{RPM} \tag{1.3}$$

where k is a unit factor. k=⅕ for DOC in inches/revolution, ROP in feet/hour, and RPM in revolution/minutes. k=16.67 for DOC in millimeters/revolution, ROP in meters/hour, and RPM in revolution/minutes.

$$\text{OBJ}=F(\mu) \tag{1.4}$$

where F is a mathematical function such as F(x)=−(x) or F=1/(x), and the bit friction factor μ is defined as $$\mu = 3\frac{TQ_b}{WOB\cdot d} \tag{1.5}$$

where $TQ_b$ is the downhole bit torque due to bit-formation interaction, and d is the bit diameter or the hole size.

$$OBJ = \frac{\delta + ROP/ROP_o}{\delta + MSE/MSE_o}, \text{ (}\delta\text{ factor to be determined)} \tag{2}$$

$$OBJ = \frac{\delta + \Delta ROP/ROP}{\delta + \Delta MSE/MSE}, \text{ (}\delta\text{ factor to be determined)} \tag{3}$$

The objective function of equation (2) is to maximize the ratio of ROP-to-MSE (simultaneously maximizing ROP and minimizing MSE); the objective function of equation (3) is to maximize the ROP percentage increase per unit percentage increase in MSE where ΔROP and ΔMSE are changes of ROP and MSE, respectively, from a first data point to a second data point. These objective functions can be used for different scenarios depending on the specific objective of the drilling operation. Note that equations (2) and (3) require a factor δ to avoid a singularity. Other formulations of the objective function OBJ(MSE,ROP) may be devised within the scope of the invention to avoid a possible divide-by-zero singularity. In equation (2), the nominal $ROP_o$ and $MSE_o$ are used to provide dimensionless values to account for varying formation drillability conditions. Such reference values may be specified by a user or determined from the data, such as, for example, using a moving average value.

It is also important to point out that the methodology and algorithms presented in this invention are not limited to these three types of objective functions. They are applicable to and cover any form of objective function adapted to describe a relationship between drilling parameters and drilling performance measurement. For example, it is observed that MSE is sometimes not sensitive to downhole torsional vibrations such as stick-slip events which may generate large oscillations in the rotary speed of a drillstring. Basically, there are two approaches to take the downhole stick-slip into account. One is to display the stick-slip severity as a surveillance indicator but still use the MSE-based objective functions as shown in equations (2) or (3) to optimize drilling performance. It is well-known that one means of mitigating stick-slip is to increase the surface RPM and/or reduce WOB. To optimize the objective function and reduce the stick-slip at the same time, the operational recommendation created from the model should be selected as the one that is compatible with the stick-slip mitigation. Another approach is to integrate the stick-slip severity (SS) into the objective functions, and equations (2)-(3) can be modified as $$OBJ(MSE, SS, ROP) = \frac{\delta + ROP/ROP_o}{\delta + MSE/MSE_o + SS/SS_o}, \tag{4}$$

(δ factor to be determined), $$OBJ(MSE, SS, ROP) = \frac{\delta + \Delta ROP/ROP}{\delta + \Delta MSE/MSE + \Delta SS/SS}. \tag{5}$$

(δ factor to be determined)

where a nominal $SS_0$ is used to provide dimensionless values. The said stick-slip severity for both approaches can be either real-time stick-slip measurements transmitted from a downhole vibration measurement tool or a model prediction calculated from the surface torque and the drillstring parameters. The stick-slip severity, SS, may be also used directly as an objective function $$\text{OBJ}=-\text{SS, OR OBJ}=1/\text{SS} \tag{6}$$

Besides stick-slip surveillance while drilling, the other benefit of this objective function is to enable operational recommendations for off-bottom rotation. When the drillstring rotates off bottom, the bit is not engaged with the formation (ROP=0, so MSE becomes infinite) and none of the other objective functions are applicable. Note that, as illustrated in this example, the objective function itself may change in time.

The objective functions described above are primarily applicable to data associated with instantaneous drilling conditions. Such measures of drilling performance, however, can become susceptible to the influence of noise and transients. To minimize these effects, we also consider objective functions which can be associated with a given depth or time interval. Such objective functions may be readily adopted for use with response points. As a non-trivial example we present the following time interval averaged objective function $$OBJ = \frac{\overline{ROP}_t^m(1 - \alpha \times \overline{TSE}_t^n)}{\overline{MSE}_{ROP}} \tag{7}$$

where $\overline{ROP}_t$ and $\overline{TSE}_t$ are the ROP and TSE averaged over a prescribed interval of time, respectively. In addition, the quantities m, α, and n are parameters which can be calibrated for a given drilling operation. The variable $\overline{MSE}_{ROP}$ is an ROP weighted average of MSE as shown in the following equation $$\overline{MSE}_{ROP} = \frac{\int_{t_k}^{t_{k+1}} MSE(t) \times ROP(t)\,dt}{\int_{t_k}^{t_{k+1}} ROP(t)\,dt} \tag{8}$$

where $t_k$ and $t_{k+1}$ are the beginning and end of a prescribed interval of time. Interval averaged objective functions such as the one shown in equation (7) may be applied directly to obtain an objective function value for a prescribed response point. A floor (i.e., minimum value) for a given interval averaged objective function can be further specified, such that the minimum value of the objective function is zero, for example. Interval averaged objective functions, such as the one given in equation (7), can also be normalized by dividing each response point value by the maximum value obtained for all the response points in the active response map.

While the above objective functions are written somewhat generically, it should be understood that each of the drilling performance measurements may be related to multiple drilling parameters. For example, a representative equation for the calculation of MSE is provided in equation (9):

$$MSE = \frac{(Torque \cdot RPM + ROP \cdot WoB)}{HoleArea \cdot ROP}. \tag{9}$$

Accordingly, when optimizing the objective function, multiple drilling parameters may be optimized simultaneously, which, in some implementations, may provide the generated operational recommendations. The constituent parameters of MSE shown in equation (9) suggest that alternative means to describe the objective functions in equations (1)-(5) may include various combinations of the independent parameters WOB, RPM, ROP, and Torque. Additionally, one or more objective functions may combine two or more of these parameters in various suitable manners, each of which is to be considered within the scope of the invention.

Local Search Methods

As described above, prior local search methods attempted to correlate a single control variable to a single measure of drilling performance (i.e., the rate of penetration) and to increase ROP by iteratively and sequentially adjusting the identified single control variable. The local search methods of the present systems and methods are believed to improve upon that paradigm by correlating control variables to two or more drilling performance measurements. At least some of the benefits available from such correlations are described herein; others may become apparent through continued implementation of the present systems and methods.

Additionally, some implementations of the present systems and methods may be adapted to correlate at least two drilling parameters with an objective function incorporating two or more drilling performance measurements. By correlating more than one drilling parameter to the objective function, multiple drilling parameters can be optimized simultaneously. As can be seen in the expressions below, changing or optimizing parameters simultaneously can lead to a different outcome compared to changing them sequentially. Any objective function OBJ can be expressed as a function (or relationship) of multiple drilling parameters; the expression of equation (7) utilizes two parameters for ease of illustration.

$$OBJ = f(x,y) \tag{7}$$

At any time during the drilling process, determined operational updates produced by the present methods can be expressed as in equation (8).

$$\Delta OBJ = \frac{\partial f}{\partial x}\bigg|_{x_{t_0}, y_{t_0}} \cdot \Delta x + \frac{\partial f}{\partial y}\bigg|_{x_{t_0}, y_{t_0}} \cdot \Delta y \tag{8}$$

In the sequential approach, however, the change is achieved in two steps: a change at a first time step and a second change at a subsequent time step, as seen in equation (9).

$$\Delta OBJ' = \frac{\partial f}{\partial x}\bigg|_{x_{t_0}, y_{t_0}} \cdot \Delta x + \frac{\partial f}{\partial y}\bigg|_{x_{t_1}, y_{t_1}} \cdot \Delta y \tag{9}$$

As a result, the two paradigms for identifying parameter changes based on an objective function may produce dramatically different results. As one example of the differences between the two paradigms, it can be seen that with the simultaneous update paradigm of equation (8), the system state at time $t_o$ is used to determine all updates. However, in the sequential updates paradigm of equation (9), there is a first update corresponding to x at time $t_o$. After a time increment necessary to implement this update and identify the new system state at time $t_1$, a second update may be processed corresponding to parameter y. The latter method leads to a slower and less efficient update scheme, with corresponding reduction in drilling performance. Exemplary operational differences resulting from the mathematical differences illustrated above include an ability to identify multiple operational changes simultaneously, to obtain optimized drilling conditions more quickly, to control around the optimized conditions more smoothly, etc.

As described in connection with FIG. 2, the present systems and methods begin by receiving or collecting data regarding drilling parameters, at least one of which is controllable. The present technology utilizes a local search engine to find optimal values for at least one controllable drilling parameter. Exemplary local search engines that may be utilized include PCA (principal component analysis), multi-variable correlation analysis methods and/or principle component analysis methods. These statistical methods, their variations, and their analogous statistical methods are well known and understood by those in the industry. Additional statistical means that may be used to identify a recommended parameter change include Kalman filtering, partial least squares (PLS, alternative term is partial latent structure), autoregressive moving average (ARMA) model, hypothesis testing, etc. In the interest of clarity in focusing on the inventive aspects of the present systems and methods, reference is made to the various textbooks and other references available for background and explanation of these statistical methods. While the underlying statistical methods and mathematics are well known, the manner in which they are implemented in the present systems and methods is believed to provide significant advantages over the conventional, single parameter, iterative methods described above. Accordingly, the manner of using these statistical models and incorporating the same into the present systems and methods will be described in more detail.

Figure 4:
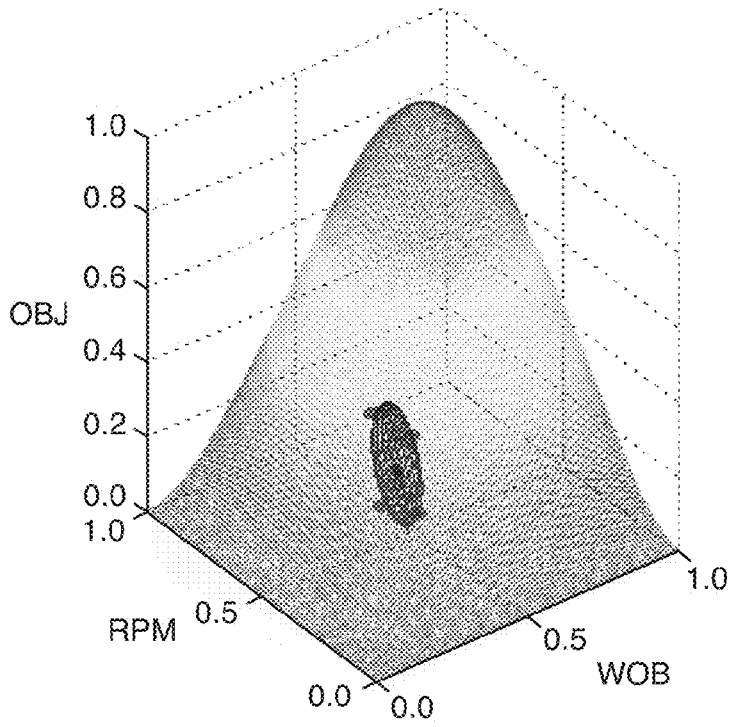
FIG. 4 illustrates the local search results moving along the gradient direction.
Figure 5:
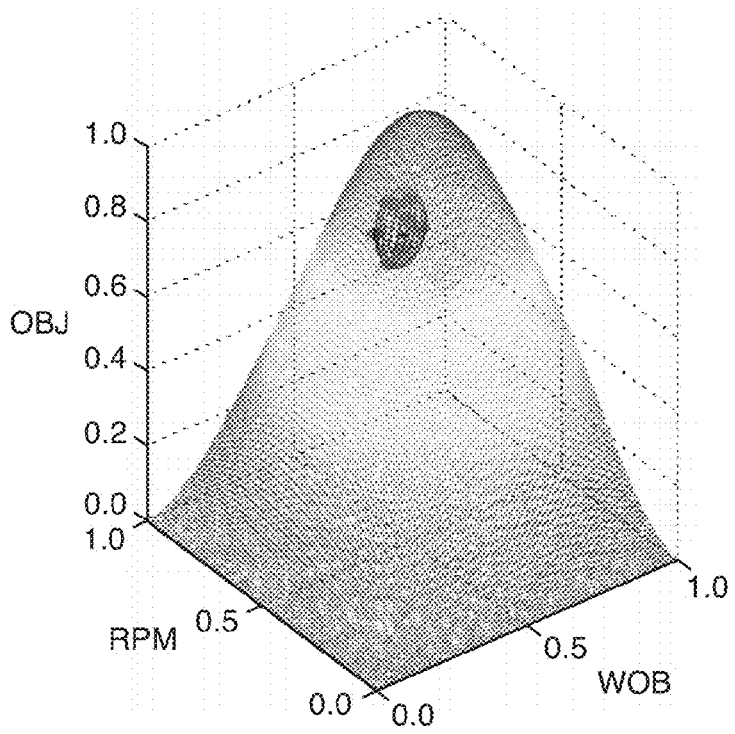
FIG. 5 illustrates the local search results close to the optimal point.

FIGS. 4 and 5 illustrate an example of searching the optimal point with a local search engine. Assume the objective function OBJ only depends on WOB and RPM, and there is only one peak within the operating ranges of WOB and RPM. Note that both RPM and WOB are normalized for illustration. Since the engine is based on local gradient, the recommended direction points along the gradient vector, and its step size is proportional to the slope. If the driller follows the recommendation, then the operating point, which is the cluster shown on the figures, moves towards the peak point. Since the step size is proportional to the slope, the step size will be close to zero when it reaches the peak point. In other words, the local search engine recommends staying at the optimal point when it gets there. In summary, (1) the local search engine can dynamically adjust the step size; (2) it is an iterative process and cannot find the optimal point at one step; (3) the effectiveness depends on the variations of the input data; (4) the searched results may be trapped at a local optimal point if the OBJ has multiple peaks. The previous patent publications WO2011016927 A1 and WO2011016928 A1 describe more details about the local search engine and the statistical method. The present invention will focus on disclosing the global search engine and its integration with the local search engine.

Global Search Methods

The global grid search engine assumes the objective function OBJ depends on the drilling controllable parameters (e.g., WOB, RPM, and flow rate) and finds the global optimal point from a windowed dataset. There may be two types of methods that can be used for the global search engines. One type is a response-surface based method, and the other is non-response-surface based method.

Figure 6:
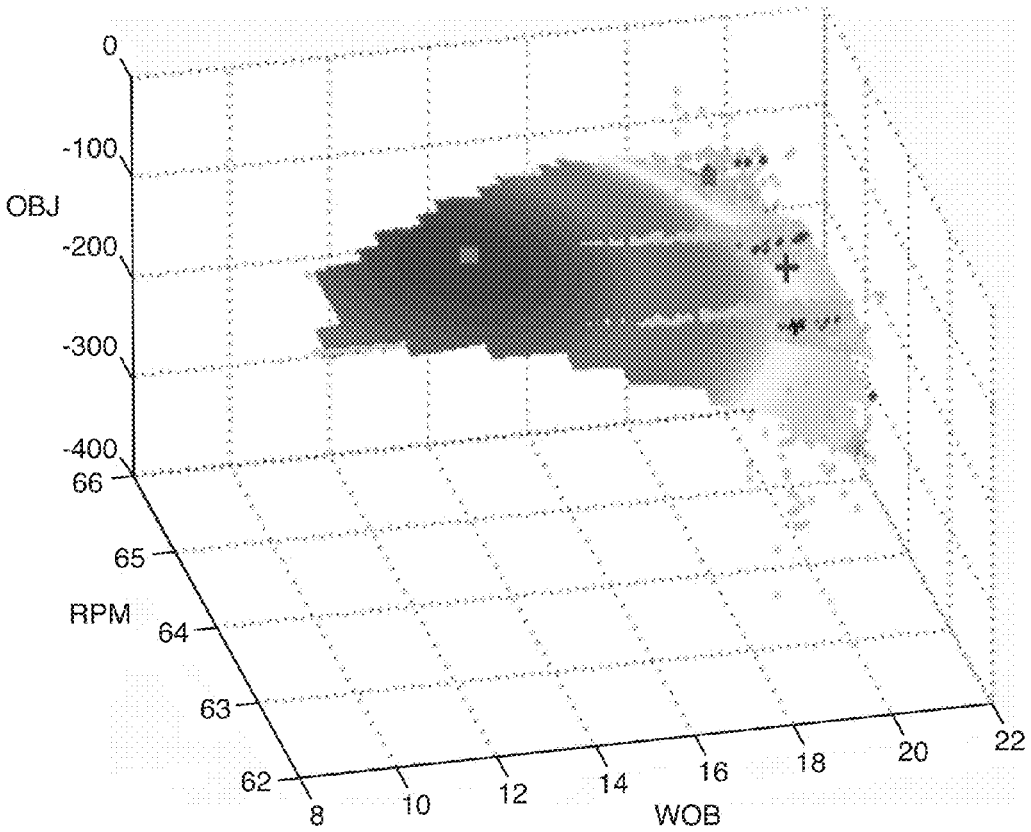
FIG. 6 illustrates the global search result with a constructed response surface from field data.

One of the embodiments of the response-surface based method includes the following steps: (1) collecting the real-time data into a moving window, (2) interpolating the response surface (the objective function as a function of at least two drilling controllable parameters) from the data, and (3) finding an optimal point from the response surface. The response surface may be constructed by a regression analysis method such as least squares regression, or any interpolation method including quadratic interpolation, higher order polynomial interpolation, Delaunary triangulation, etc. FIG. 6 illustrates one example of the response surface of negative MSE as a function of WOB and RPM via a quadratic regression method. For real-time implementation, an FIFO (First-In-First-Out) buffer can be used to collect live data, and the response surface can be updated for each time update. With the constructed surface, the optimal point can be found immediately. However, the effectiveness of the global engine also depends on the input data variety.

The other type of global search engine does not require building the response surface. One of the embodiments is called the "driller's method" which is similar to the traditional "drill-off test". The relevant parameters may be RPM and WOB, but without limitation other parameters may also be included such as mud pump rate, standpipe pressure, etc. In this exemplary method, the operating parameter space is provided by consideration of the maximum available WOB, the rig rotary speed limitations, minimum RPM for hole cleaning, as well as any other operational factors to be considered by the drilling organization, whether deemed as performance limitations, bit limitations, rig limitations, or any other factors. The maximum and minimum WOB and RPM are thus provided but could be subject to change for a subsequent drilling interval. The driller's method does not need any hyper-dimensional regression or interpolation method.

Figure 7:
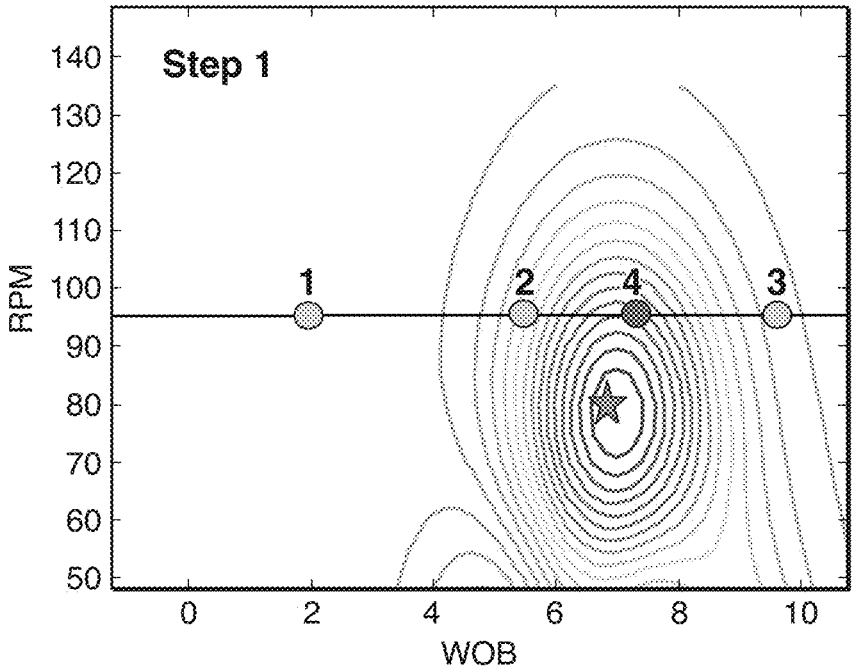
FIG. 7 illustrates the first step in a grid search using the Driller's Method, holding RPM constant and varying WOB.
Figure 8:
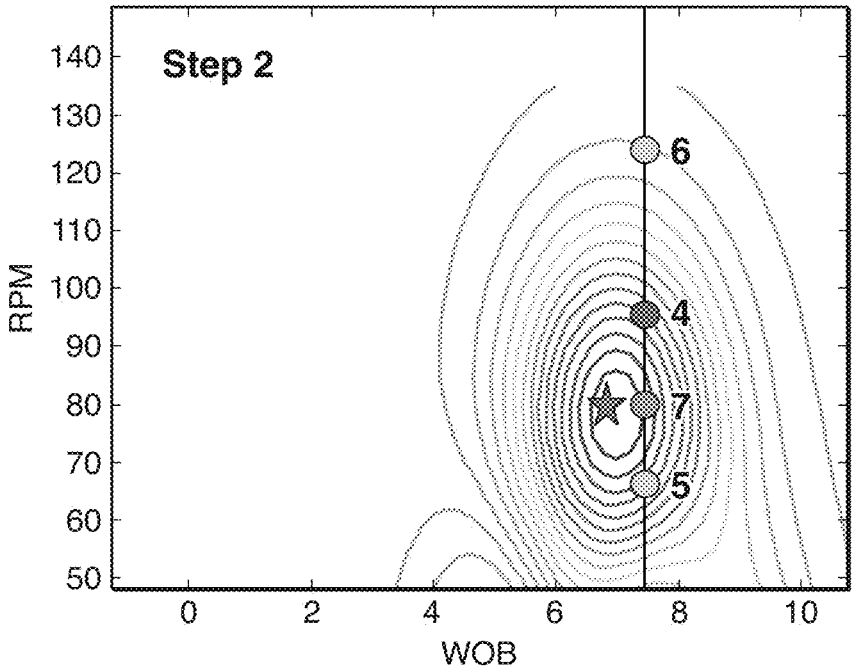
FIG. 8 illustrates the second step in a grid search using the Driller's Method, holding WOB constant and varying RPM.

FIGS. 7 and 8 illustrate how to implement the driller's method. In FIG. 7, Step 1 illustrates that the driller commences drilling with an operational parameter set 1. This operating condition is maintained just long enough to establish a consistent value for a selected objective function, such as those identified in Equations (1-5). For example, the MSE (Mechanical Specific Energy) may be a good selection for an objective function, which is shown by contour lines on FIGS. 7 and 8.

In Step 1 (FIG. 7), after sampling the drilling at parameter set 1 for an appropriate time interval (say two to five minutes, for example), the WOB may be increased at the same RPM to parameter set 2. After drilling a suitable amount of time at this condition, the WOB is then changed to parameter set 3. With drilling results and corresponding objective function values at three parameter sets, a polynomial curve fit, or some other function, may then be calculated. The optimum value of WOB, for fixed RPM, may then be calculated as parameter set 4. Alternative embodiments, with fewer or greater numbers of sample parameter sets, may also be chosen. Also, Step 1 may be chosen with fixed WOB and variable RPM, or alternatively, both may be varied simultaneously, requiring fitting the data to a two-dimensional surface. One embodiment of simultaneously alternating RPM and WOB values may be based on a Fractional Factorial test of Designs of Experiments (DOE). More generally, if there are N operating parameters to be optimized, the data may be fit to a surface of dimension up to N. Other implementations for processing a defined grid of operating parameter values may be conceived without departing from the scope of the invention.

Continuing with the Driller's Method, Step 2 as shown in FIG. 8 comprises holding the WOB at the value obtained for parameter set 4, which was found to be the optimal WOB at the initial value for RPM based on a curve fitting method. (In other embodiments, this step may not be required, and the optimal WOB may be used directly for different RPM values.) After drilling at parameter set 4 for some period of time, the RPM may be reduced for parameter set 5 and then increased for parameter set 6, for example. As before, with drilling results and corresponding objective function values at three parameter sets, a polynomial curve fit, or some other function, may then be calculated to identify the optimal RPM at this particular WOB. The parameter set 7 identified by the green dot is so obtained. In this example, the parameter set 7 is close to the theoretical optimal value identified by the red star in this chart.

One other type of global search engine that does not require building the response surface is called the Downhill Simplex Method (also called the Nelder-Mead method). This method involves collecting a minimum of N+1 points in an N-dimensional parameter space by conducting parameter (WOB, RPM, etc.) variations similar to a 'drill-off' test, for at least two controllable drilling parameters. Once the points are collected and a suitable objective function OBJ is ascribed to each point, the point with the lowest (worst) value of OBJ is identified as a candidate for reflection. A simplex is constructed by calculating the convex hull of the remaining N points. The candidate point for reflection is then reflected across the centroid of the simplex to obtain a recommendation for a subsequent set of parameters for drilling. This sampling process can be iterated as more response points are obtained for continuous optimization.

There are many ways to conduct a global search. General methods for a global grid search are well known in the art, such as the Simplex, Golden Search, and Design of Experiments (DOE) methods. Several of these are provided in the reference, "Numerical Recipes in C," by W. H. Press et al.; and Nelder, John A.; R. Mead (1965). "A Simplex Method for Function Minimization". *Computer Journal* 7: 308-313; both of which references are incorporated herein by reference.

Combined Methods for "Data Fusion"

After obtaining results for the global and local search engines, the next key step is how to combine the recommendations from the two engines. One of the embodiments is to use a data fusion method to dynamically combine the search results from the two engines. "Data fusion" is a relatively new term used to describe a broad set of analytical methods. An exemplary reference is "An Introduction to Multisensor Data Fusion," by Hall and Llinas, Proceedings of the IEEE, Vol. 85, No. 1, January 1997.

Figure 9:
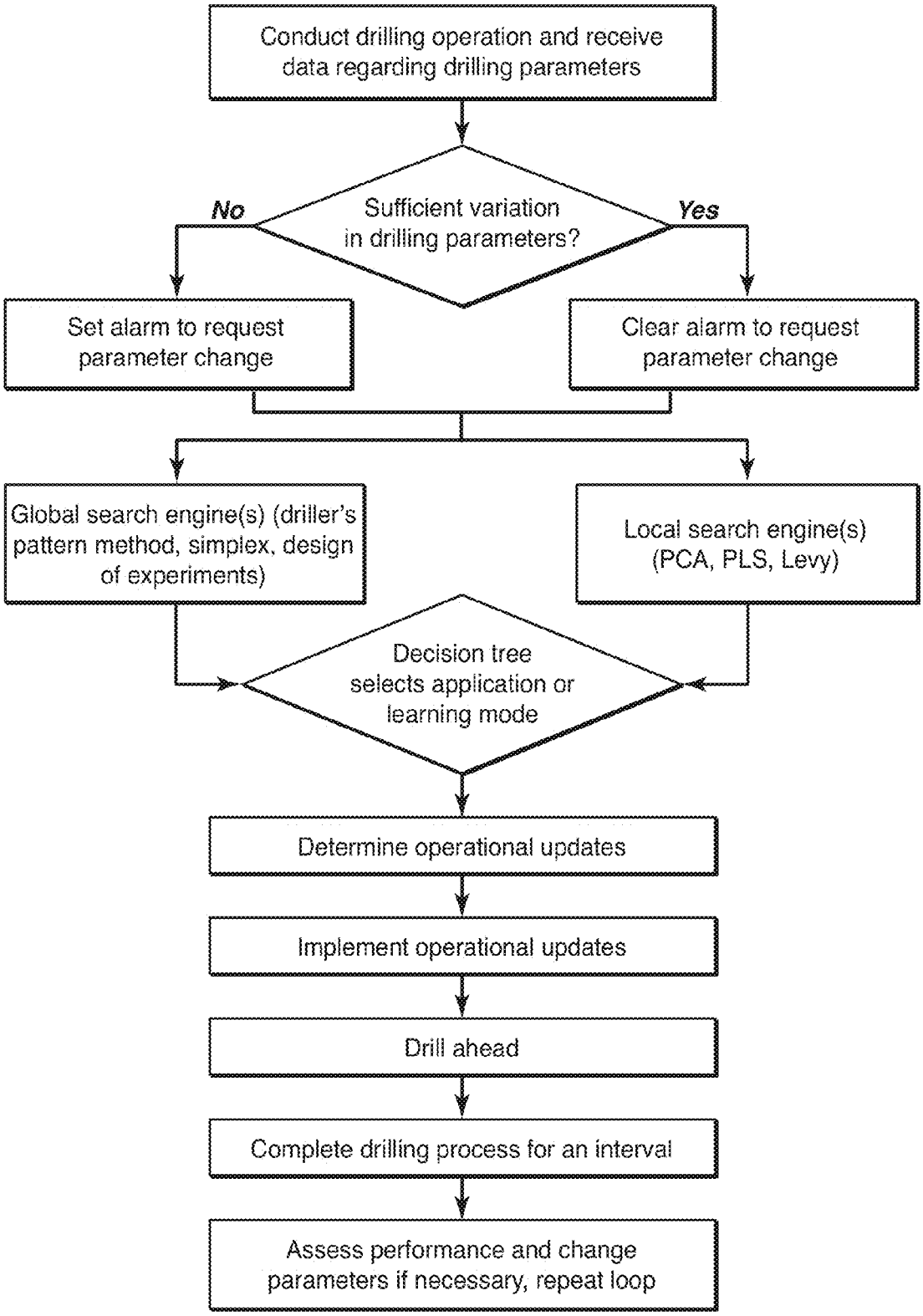
FIG. 9 is a flow chart of a drilling advisory system combining a local search engine and a global search engine for generating operational recommendations using a decision tree.

FIG. 9 is a flow diagram of the improved drilling advisory system (DAS) method. While drilling, the system is receiving data regarding the drilling parameters. A process is constantly checking the drilling parameters to determine if there is sufficient variation in the parameters for statistical validity. In one non-limiting approach, a count-down timer may be running on an ongoing basis. The timer starts to count down from the most recent change in parameters detected by the system. If no parameter is subsequently changed over a period of time (for example, 15 minutes) or depth, an alarm will be triggered and communicated to the driller via a visual indicator on the computer screen and/or an audio signal to remind the driller to change at least one drilling parameter. The timer is reset whenever a change is detected in one of the controllable parameters beyond some threshold amount. This step ensures that the drilling advisory system is fully utilized, because both global and local engines do not function well if there is no parameter change in the windowed dataset. In some embodiments, the use of the response score may render a countdown timer redundant or unnecessary.

The local and global search engines may run in parallel and/or in serial mode. Key factors that contribute to selecting an engine include the history of knowledge of the drilling operations; detection of a significant change in the drilling process; specific time or depth trigger points; identification of a drilling dysfunction of the drilling process; an increase in a fundamental metric of the process, such as an increase in the MSE or a vibration score that may depend on an adjusted MSE value; or at the direction of the driller based on his or her specific knowledge of the drilling process and the present status of the operation. Statistical tests of the search results may also be used to assess statistical validity using a decision tree. If the tests are passed, then an application mode displays the results of data fusion of global and local search results. If the tests fail, then a learning mode may be activated indicating that more data is needed to increase the statistical validity of the calculations. In this learning mode, the methods used for the global and local search as well as data fusion could be different from the application mode. The objective of the learning mode is to provide guidance on how to change parameters to obtain sufficient data to pass the tests of statistical validity.

The count-down timer is a simple method to ensure sufficient variation in drilling parameters to achieve statistically significant results. Alternatively, the windowed dataset may be evaluated directly to determine if it is statistically significant. In general, to optimize a system dependent on N parameters, there must be a minimum of N+1 parameter sets within the data window to evaluate the process.

First, the combined method enables the driller to initiate the drilling optimization process by quickly scanning the operating parameter space. The data window is quickly filled with a variety of operating conditions, and the objective function map is coarsely sampled.

Second, when the objective function is subject to significant change, for example when the drill bit encounters a substantially different formation, the data window becomes stale and may be discarded. The grid search method then allows the data window to be refilled with drilling data observed in the new formation, and the statistics-based methods may be restarted. From a driller's perspective, the automated system no longer has relevant data, and the combined method recognizes this fact.

Third, every so often, to ensure that the objective function map has not changed significantly without detection, a global search engine can be quickly performed and the local search engine subsequently restarted or continued with fresh data from a broader set of operating parameters.

The two approaches work together to provide a system and associated methods that can be used under a wide variety of operating conditions. The global search provides some measure of protection against being stuck in a local optimum, since it is capable of spanning the entire operating parameter space. The local search engine is then well-suited to searching with smaller step sizes to optimize the objective function in a local sense.

In the event that there is a significant change in the objective function, or after a suitably long duration of time or depth without changes in drilling parameters, the grid search method may then be repeated, with the same or different trial operating parameter sets. It may be determined that the DAS data window should be flushed and restarted, but one option would be to continue to supplement the current data window with the new grid search results and any subsequent drilling data. These combined grid and statistics-based methods provide a robust drilling advisory system and methods. For change detection, various methods are available to identify a state change between different observation data sets, including statistical mean differences, clustering methods (K-means, minimax), edge detection methods (Gaussian filtering, Canny filtering, Hough Transform, etc.), STA/LTA (short-term average divided by long-term average), Kalman filtering, state observers, Bayesian Changepoint Detection (ref: Adams and MacKay), and other numerical techniques.

Response-Point Based Decision Tree Methods

In one respect, a response point-based decision tree method may be used to determine if the results of the data fusion recommendations are satisfactory, or if the system should switch to a learning mode based recommendation. A response score or objective score may not pass a specified threshold, or some other trigger (such as bit-balling detection) may cause the decision tree method to choose a different path. Additionally or alternatively, there is a certain amount of knowledge about the drilling condition that may be considered in a decision tree approach. In addition, a drilling dysfunction map may be a useful tool in a decision tree method.

Figure 10:
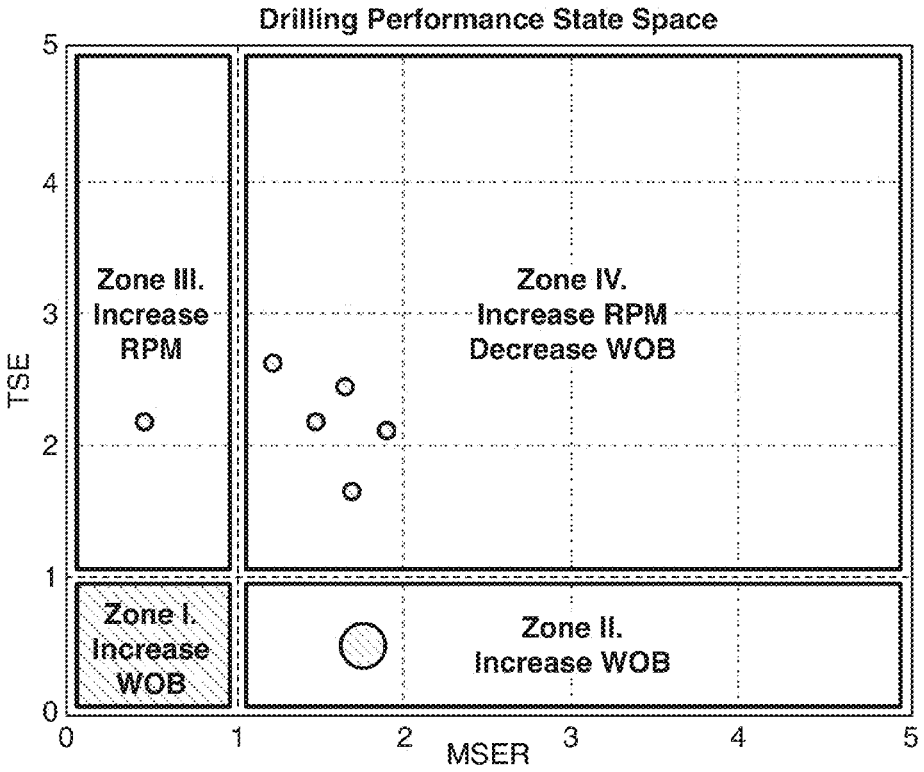
FIG. 10 is an exemplary drilling dysfunction map with four zones that may be used by a decision tree method to generate operational recommendations.

As shown in FIG. 10, a Drilling Performance State Space can be created by cross-plotting MSER and TSE. This may be accomplished on a 2-D chart in real time. The MSER ("MSE Ratio") is a normalized MSE value that is adjusted for depth, well profile, and formation effects. This allows different drilling conditions to have similar values for MSER, whereas we typically find lower values for an un-normalized MSE in softer formations and higher MSE values in harder rock. The MSER is described more fully in "Drilling Vibration Scoring System," International Application No. US2012/050611, incorporated herein in its entirety. TSE ("Torsional Severity Estimate") is the ratio of the current bit rotary speed fluctuations to the corresponding rotary speed oscillations at full stick-slip conditions. The TSE is described more fully in PCT applications WO2011-017626 ("Methods To Estimate Downhole Drilling Vibration Amplitude From Surface Measurement") and WO2011-017627 ("Methods To Estimate Downhole Drilling Vibration Indices From Surface Measurement"), incorporated herein in their entirety. At full stick-slip, the bit typically comes to a full stop and then accelerates to two times the nominal rotary speed, reflecting a sinusoidal oscillation about the nominal RPM.

The chart in FIG. 10 contains four zones: Zone I for good state with no perceived dysfunctions, Zone II for whirl state, Zone III for stick-slip state, Zone IV for whirl and stick-slip coupled state. The purpose of using this tool is to identify the current drilling performance state. Then we can generate recommendations for parameter changes by checking the lookup table in order to move the current drilling state towards a better condition, preferably Zone I, or to push the current operation limits if it currently has no dysfunction and is already in Zone I. This dysfunction map can be used by the decision tree method to guide learning mode recommendations, for example.

Figure 11:
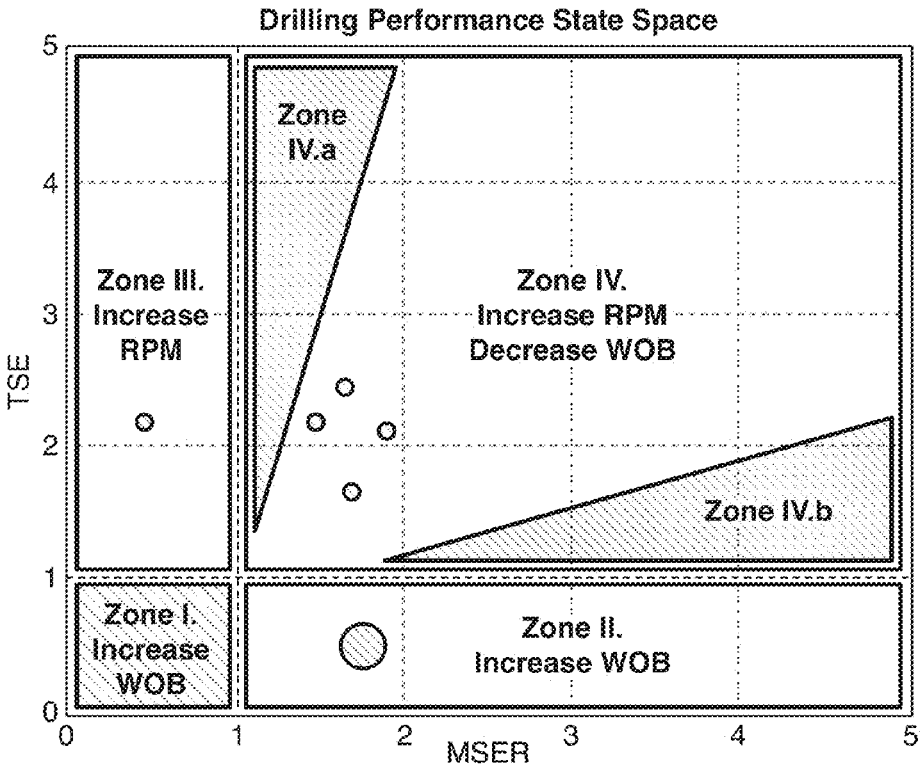
FIG. 11 is an alternative exemplary drilling dysfunction map with six zones that may be used by a decision tree method to generate operational recommendations.

A drilling performance state space may be divided into more than four zones. For example, in FIG. 11 we present a performance state space consisting of six state zones, and two sub-zones which are split from the coupled whirl-stick-slip zone IV of FIG. 10. For example, Zone IV.a is a coupled whirl-stick-slip zone in which stick-slip is dominant. On the other hand, Zone IV.b is coupled but whirl-dominant. Note that the size of the sub-zones, as indicated in FIG. 11, is for illustration only and is not limiting. Other zone partitioning of the drilling dysfunction map may be used, either larger or smaller, as necessary.

The critical values between zones may depend on certain drilling conditions, and it is not expected that the boundaries are particularly fixed. Generally, TSE=1 and MSER=1 may be used as critical values to separate between good and stick-slip zones along the MSER axis, and good and whirl-dominant zones along the TSE axis.

The axes of the drilling performance state space are not limited to MSER or TSE. Other embodiments of the axes can be at least any of the two normalized drilling state variables: axial vibrations, equivalent circulation density (ECD), etc. These drilling state variables may be normalized by using similar approaches for computing MSER. Furthermore, this method may be performed with a single state space variable, say MSER for example, or alternatively, the method may use three or more states, with appropriate adjustments to figures and calculations. Finally, the system may have a learning element in which it may detect the drilling dysfunction and can optimize to select the best value for the boundary parameter(s) using an approach based on optimization of an objective function.

For each zone on the drilling performance state space, the recommendations for WOB and RPM can be generated from guidelines, as shown in exemplary Table 1, a knowledge-based recommendation table. The recommendation table may provide the polarity on how to change drilling parameters (i.e. increase, decrease and hold). In some cases, the table may not provide the actual value. In this case, the step size for parameter changes may be selected in advance or calculated in consideration of the data fusion results to generate recommended values for drilling parameter changes.

TABLE 1

Knowledge based Recommendation Table

| Zone | Drilling Performance State | Recommendation |
|---|---|---|
| I | Good, no dysfunction | Increase WOB (primary)<br>Increase RPM (secondary) |
| II | Whirl dominant | Increase WOB (primary)<br>Reduce RPM (secondary) |
| III | Stick-slip dominant | Increase RPM (primary)<br>Reduce WOB (secondary) |
| IV | Whirl Stick-slip Coupled | Increase RPM (primary)<br>Reduce WOB (secondary) |
| IV.a | Whirl Stick-slip Coupled but Stick-slip dominant | Increase RPM (primary)<br>Reduce WOB (secondary) |
| IV.b | Whirl Stick-slip Coupled but Whirl dominant | Increase WOB (primary)<br>Reduce RPM (secondary) |

Illustrative, non-exclusive examples of systems and methods that may be incorporated into the inventive methods and systems are presented in the following. It is within the scope of the present disclosure that the individual steps of the methods recited herein may additionally or alternatively be referred to as a "step for" performing the recited action.

Response Point Sample Applications

Figure 12:
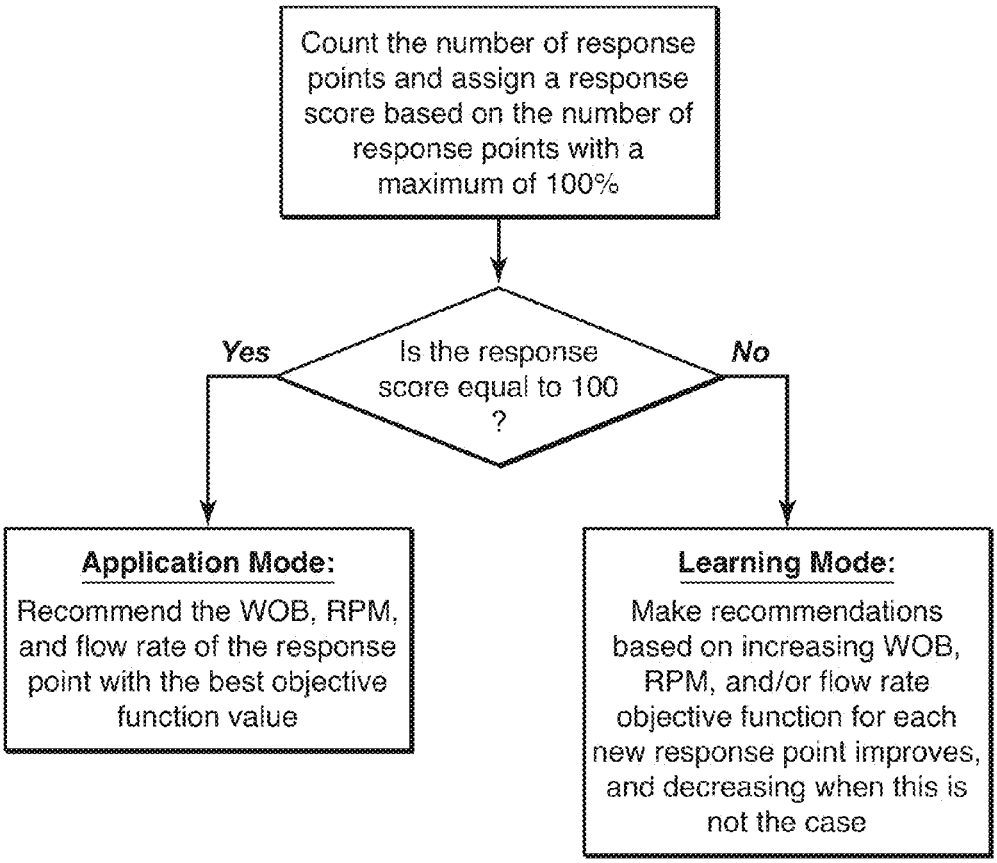
FIG. 12 is a flow chart showing an example of a response point-based decision tree for selecting between an application mode and a learning mode.

In the first example, after 90 minutes of drilling, the response score of 100% is achieved after 20 response points are obtained. FIG. 12 illustrates the response score-based decision tree for this example. Based on a response score of 100%, this decision tree activates an application mode and displays the drilling parameters corresponding to the response point with the optimum interval-averaged objective function value, which are a WOB of 10,000 pounds and an RPM of 120. After an additional 10 minutes of drilling, the objective function scores for the three most recent response points are found to be less than 40%, as shown in Table 2:

TABLE 2

| No. | WOB (time avg.) | RPM (time avg.) | Flow rate (time avg.) | Objective Score |
|---|---|---|---|---|
| 1 | 15.0 | 100.0 | 1100.0 | 0% |
| 2 | 17.0 | 80.0 | 1100.0 | 0% |
| 3 | 9.0 | 100.0 | 1100.0 | 100% |
| 4 | 14.0 | 120.0 | 1100.0 | 32% |
| 5 | 12.0 | 110.0 | 1100.0 | 59% |
| 6 | 10.0 | 81.6 | 1100.0 | 62% |

TABLE 2-continued

| No. | WOB (time avg.) | RPM (time avg.) | Flow rate (time avg.) | Objective Score |
|---|---|---|---|---|
| 7 | 16.0 | 70.0 | 1100.0 | 0% |
| 8 | 9.5 | 110.0 | 1100.0 | 92% |
| 9 | 19.0 | 121.8 | 1100.0 | 34% |
| 10 | 6.0 | 150.0 | 1100.0 | 60% |
| 11 | 6.0 | 145.0 | 1100.0 | 54% |
| 12 | 5.5 | 140.0 | 1100.0 | 29% |
| 13 | 7.0 | 75.0 | 1100.0 | 39% |
| 14 | 7.0 | 110.0 | 1100.0 | 34% |

Exemplary Table 2 provides a number of response points and for each it displays the associated controllable parameters, indicated as WOB, RPM, and Flow rate. Each of the controllable parameters has an assigned range of tolerances for each response point's 60 seconds of data, such as ±2 Klbs for WOB, ±5 RPM for rotary speed, and ±50 flow units per minute for flow rate. To be considered a response point, the data must be determined useful; meaning the property in question is not only have a mean or average value within a useful range, but also and separately must be determined to have been held relatively steady during the subinterval(s) or period being evaluated, such as having a data scatter that is within one standard deviation of the mean or some other reference value. The objective score is provided to help determine the best performing response point.

Figure 13:
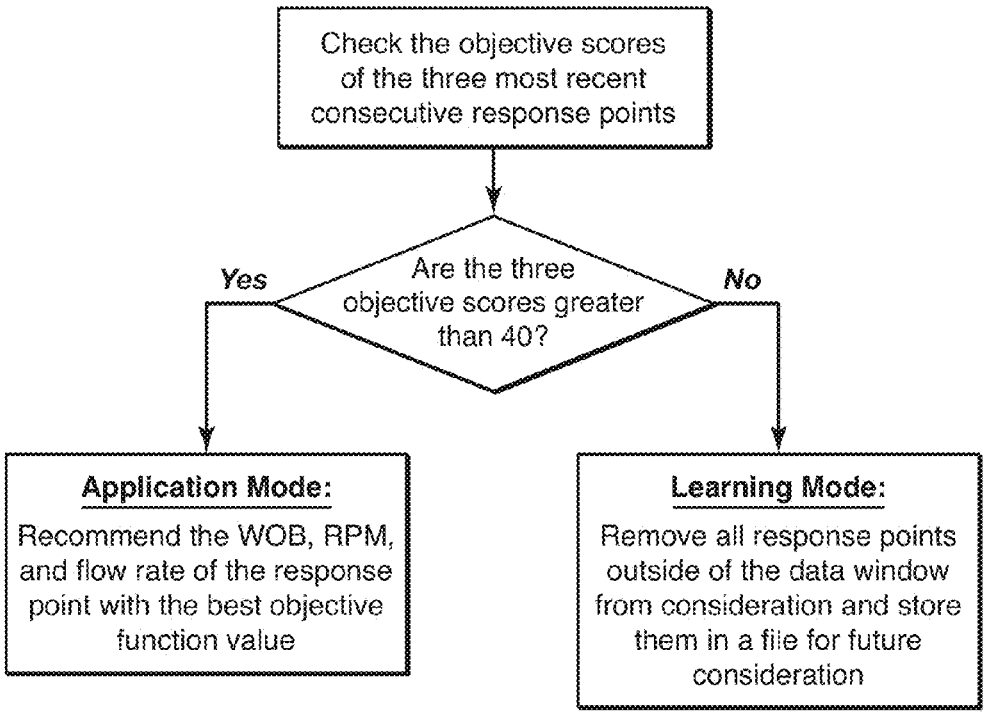
FIG. 13 is a flow chart showing a second example of a response point-based decision tree for selecting between an application mode and a learning mode.

A decision tree may be activated, as shown in FIG. 13, which can trigger a learning mode that removes all response points outside of a data window containing the most recent 20 minutes of received data. This in turn may drop the response score to 25% and indicate to the driller that more data is needed to produce a valid recommendation. In the learning mode, a stick-slip branch of a decision tree may be activated such as due to a TSE greater than 1.1, and recommendations of WOB of 10,000 pounds and a lower RPM of 110 may be displayed to indicate where useful additional data and response points may be obtained.

In the second example, the data window is 60 minutes. After 200 minutes of drilling, the response point with the largest objective function value has the average values of 20,000 pounds WOB and 170 RPM. A new response point is generated that is within specified tolerances of 1,000 pounds WOB and 5 RPM of this optimum response point, and the previous response point is over-written. The new response point is at 20,500 pounds WOB and 168 RPM, but it no longer has the optimum average objective function value. The available response points are searched, and the response point with the optimum average objective function value has values of 15,000 pounds WOB and 150 RPM. The response score remains 100% because there are still more than 20 response points, but the objective score has dropped from 100% to 25% because the current drilling parameters of 20,000 pounds WOB and 170 RPM is no longer at the optimum response point. Since the objective score of 25% is less than a specified threshold of 40%, a recommendation is displayed for the parameters of the new optimum response point, which are 15,000 pounds WOB and 150 RPM.

In the third example, drilling has just begun and there is only one response point generated by holding the current parameters. The response score is 5% (5% for each response point), and since this is less than a threshold of 100%, a learning mode is activated. A recommendation is displayed to increase WOB a specified step size of 2,000 pounds from the current parameters of 5,000 pounds WOB, 80 RPM, and a flow rate of 500 gallons per minute. The driller increases WOB as recommended, and this results in the generation of a new response point and an increase in the combined objective function value, which is calculated from a time-averaged ROP, time-averaged TSE, and ROP-weighted average of MSE. Since the objective function value increased, the next recommendation is to increase the WOB an additional step size of 2,000 pounds from the current parameters of 7,000 pounds WOB, 80 RPM, and a flow rate of 500 gallons per minute. The driller increases WOB as recommended, generating a third response point. The objective function value of this third response point decreases relative to that of the second response point, so the next recommendation is to increase RPM by a specified step size of 5 RPM from the current parameters of 9,000 pounds WOB, 80 RPM, and a flow rate of 500 gallons per minute. The driller increases RPM as recommended, generating a fourth response point, which has an objective function value greater than the third response point. This learning mode process continues until 20 response points are obtained, resulting in a response score of 100%, which triggers an application mode that recommends the averages of the parameters of the best response point and the results of a local search engine.

Figure 14:
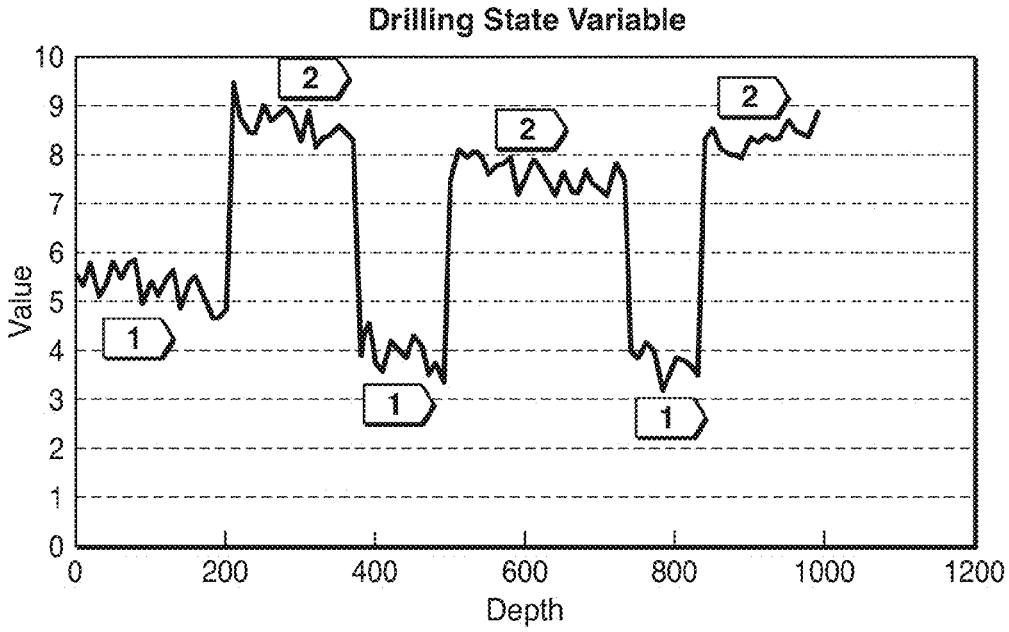
FIG. 14 illustrates an example of how changes in value of a drilling state variable are associated with two response maps.

In the fourth example, a well is being drilled in an area with laminated formations that comprise alternating sand and shale sequences. This lithology naturally provides for two (or more) distinct drilling system responses. A separate response map will be generated for each lamination type, and one or more drilling system state variables are used to distinguish the laminations. A drilling state variable can be the objective function itself. Consider a simple example shown in FIG. 14 in which a single drilling state variable is observed to fluctuate between two different data ranges. More generally, more than one drilling state variable may be appropriate, but this example uses a single variable, such as TSE. The drilling state switches back and forth between state 1 and state 2 as depth increases.

Figure 15A:
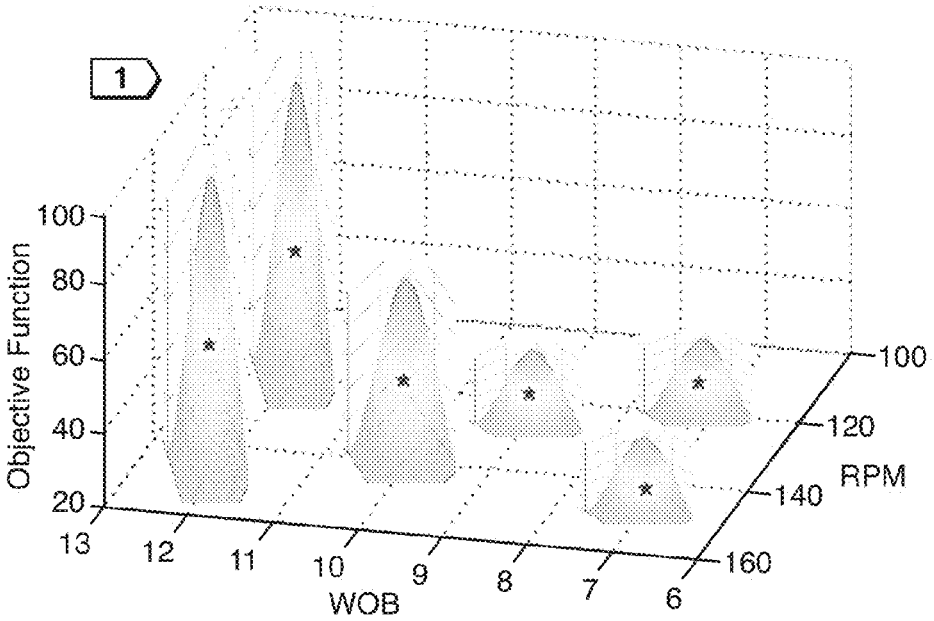
FIG. 15A and FIG. 15B each illustrate an exemplary response map.
Figure 15B:
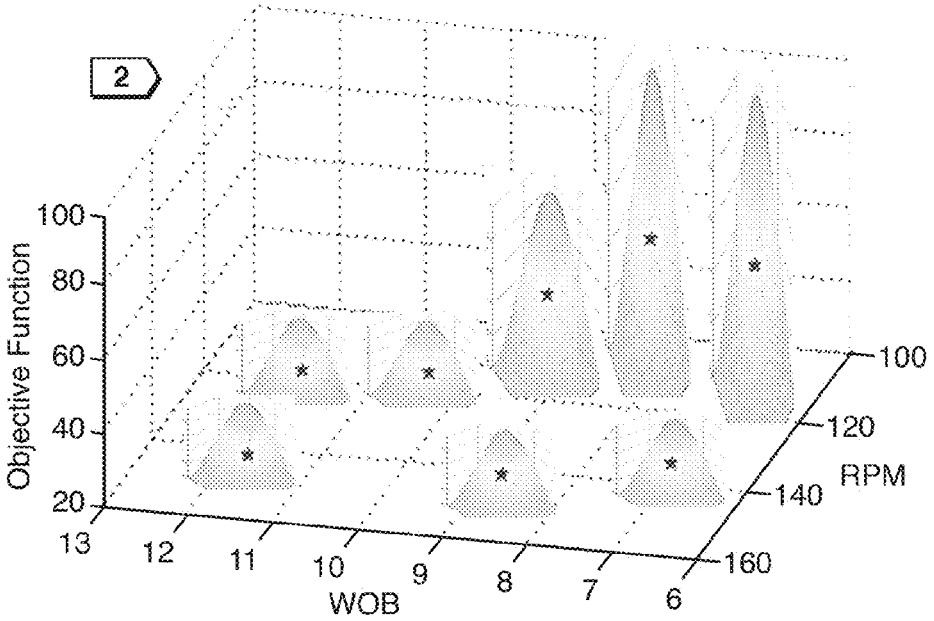

FIG. 15 illustrates two response maps, one that is gathered when drilling state 1 is the current drilling environment and another that corresponds to drilling state 2. In drilling state 1, the objective function values are higher when drilling with higher WOB, whereas for drilling state 2 it is found that the objective function values are lower for higher WOB values. Therefore, as the well is drilled deeper, when the drilling state value changes from 1 to 2, and then back to 1, the currently active response point map, comprising both objective function values and response point values, will be alternatively stored and restored as the drilling state changes. This method preserves the information gathered for intervals with common drilling state values. This simple example may be generalized to multi-variable drilling states (such as MSE, TSE, and bit friction factor) and multiple ranges of common values. For example, instead of just two drilling state ranges, there may be five identifiable drilling state data ranges.

Data Quality Filter and Response Point Scoring System

According to the presently disclosed and claimed method and system, specified criteria and quantities are described that are used to trigger actions described in conditional statements. These specified criteria and quantities can be adjusted to improve operational adjustments for drilling a particular wellbore. Temporally evolving data while drilling consist of measured quantities taken at a certain frequency, such as once every second. Temporally evolving data means that measured quantities such as but not limited to weight-on-bit (WOB), rotary speed (RPM), flow rate, and block height, each of which can be changing every time measurements are taken (e.g., every second, every 5 seconds, etc.). At each time all of the received measured quantities constitute a data point. An interval of drilling time is a duration of time when a selected number of data points are received during drilling. For example, an interval of drilling time may be from 3:30 p.m. to 4:00 p.m. on a given day and may correspond to 1800 data points if a data point is received every second for that 30 minute duration.

Within a set of data points corresponding to an interval of drilling time, non-overlapping subintervals are single a single set or contiguous subsets of data points that meet selected criteria of suitability. For example, a 30 minute interval of drilling time can be divided into 30 non-overlapping subintervals that are each one minute long and consist of 60 consecutive data points corresponding to each second within each minute. Each non-overlapping subinterval is checked for selected quality control criteria, such as whether the number of data points is within a specified range of number of data points, whether the standard deviation of a particular measured quantity is less than or equal to the specified tolerance for that quantity, and whether the mean value of a particular measured quantity is within a specified range for that measured quantity.

An example may include checking whether a subinterval has at least 60 but no more than 300 consecutive data points (e.g., from 1 to 5 minutes), whereby for one subinterval unit (e.g., 60 seconds) or a continuous sequential group of subintervals (e.g., 120 or 180 seconds). For the subinterval, the data reflects (i) a standard deviation in the data scatter of the WOB of the same data points within the subinterval that is less than or equal to a specified tolerance of ±2 klbf, and (ii) a mean WOB value of the same data points is within a selected analysis range, such as a range of 5 klbf to 24 klbf. In another example, the received data points may reflect (i) a standard deviation of the RPM of the same data points of no more than a specified tolerance of ±10 RPM, and (ii) a mean RPM value of the same data points between a range of 50 RPM and 150 RPM.

Each non-overlapping subinterval identified as meeting specified criteria from a set of data points received at a certain time subinterval(s) is cataloged as a response point by calculating quantities from the subinterval data and associating them with a response point identifier. Each response point is a collection of quantities calculated from data points in a subinterval meeting specified criteria, and examples of quantities constituting a response point may include the mean values of controllable drilling parameters such as WOB, RPM, and flow rate, the timestamp of the most recent data point within the subinterval, and functions of one or more measured quantities within the subinterval that could be used for quantifying desired performance or detecting a dysfunction condition.

The cataloged response point may be recorded for analysis, and examples of recording a response point would be storing a response point in a computer database file or computer memory. A recorded response point is located within a response map, which is a collection of response points, and a response database is a collection of all response points that meet specified criteria to be preserved for future analysis. The database may also include a collection of response maps, such as for different drilling conditions or set of controllable drilling properties, or for each of a variety of formations or wellbore conditions being drilled.

Response maps may have different criteria for adding or removing response points than the response database because they are used to represent drilling conditions over a duration of time, whereas the response database is used to represent a history of drilling conditions. Response points are selected from a response map or from the response database on the basis of desirable characteristics, and operational adjustments for drilling the wellbore are made on the basis of these selected response points. For example, a desirable characteristic can be the best objective function value, so the response point with the best objective function value is selected from the current response map, and the WOB and RPM while drilling are changed to match the values of that response point.

Depending on the definition of the objective function, the best value may be the maximum or the minimum value. In addition, correlation coefficients between the objective function and the controllable drilling parameters can be used to find a potential direction for improving the objective function. A correlation coefficient can be multiplied by a specified step size, which is the maximum change allowed in a controllable drilling parameter when a correlation coefficient is at its maximum value of one. A direction is found by multiplying each correlation coefficient with its corresponding step size, and operational adjustments can be made by adding the direction to the current drilling parameters, the parameters of the best response point, or the mean values of the parameters of the current drilling parameters and the parameters of the best response point.

A rate of penetration (ROP) for each response point can be based on the change in block position over a duration of time. Since there may be oscillations in the block position, the change in block position can be determined using the mean values of block position and time for subsets of data points within the subinterval of data. For example, oscillations in block position with a 10 second period are averaged out by taking the mean value of the block position of 10 consecutive data points. For a 60-second subinterval, ROP is calculated using the mean block position and time of the first 10 data points and the mean block position and time of the last 10 data points. Hence, for the response point created from that subinterval, ROP is the change in mean block position divided by the change in mean time.

To keep a response map current, older response points may be replaced by a new response point if they are within specified tolerances of the controllable drilling parameters. For example, a new response point at 10 klbf WOB and 110 RPM is within the specified tolerance of ±1 klbf WOB and ±5 RPM of a previous response point at 9 klbf WOB and 107 RPM, so replacement occurs by adding the new response point to the response map and removing the previous response point from the response map.

A scoring system may be used to quantify the state of a subset of received data points and/or the state of a response map. This can be the current response map, which consists of the most recent response points that were either created where no previous response point was within specified tolerances, or replaced previous response points that were within specified tolerances. The subset of received data points can consist of the most recent data points, such as the 300 data points received over the most recent five minutes.

A response score may merely be a comparison of the number of response points within a response map and a specified number of response points. The response score can be the ratio of the number of response points and a specified threshold number of response points, and it can be expressed as a percentage. An example would be 7 response points in a response map and a specified threshold number of 10 response points, resulting in a response score of 70%. Beyond the specified threshold number of response points, the response score can be capped at 100%. Thus, 14 response points with a specified threshold number of 10 response points would result in a response score of 100%.

An objective score can compare the objective function values of a response points in a response map. The objective score may be calculated as the response score times the ratio of the objective value of the most recent response point and the maximum value in the response map. For example, a response score of 100%, an objective function value of 0.5 for the most recent response point, and a maximum objective function value of 1 results in an objective score of 50%. Note that an objective function can be defined such that the minimum value is the optimum, but a modification such as the inverse of the objective function results in the maximum value becoming the optimum. The response score and/or the objective score can be used to select from different modes of generating recommendations for controllable drilling operational parameters, which are organized in a decision tree. For example, a decision tree has learning modes and application modes that are selected based on whether the response score is 100%.

If the response score is less than 100%, a learning mode is activated where recommendations are generated based on the most recent response point. If the response score is 100%, the decision tree selects from multiple application modes based on whether the objective score is greater than or equal to 50%. In contrast to the learning modes, the application modes are based on the response point with the optimum objective function value and the current parameters.

A response map may be used to represent a formation, and when drilling through alternating formations, it can be useful to recall a previous response map. A previous response map can be made the active response map by recording the current response map and then replacing it with the previous response map. The criteria for making a previous response map the active response map can be based on one or more drilling state variables, which can be received measured data or functions of received measured data. An example of a drilling state variable is mechanical specific energy (MSE), which may be used to identify a formation change when it decreases more than the standard deviation of MSE in a response map with at least 10 response points.

INDUSTRIAL APPLICABILITY

The systems and methods described herein are applicable to the oil and gas industry.

In the present disclosure, several of the illustrative, non-exclusive examples of methods have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities, other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" may mean A alone, B alone, C alone, A and B together, A and C together, B and C together, A, B and C together, and optionally any of the above in combination with at least one other entity.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A method of drilling a wellbore through a subterranean formation, the method comprising the steps of:

(a) receiving temporally evolving data from a drilling system while drilling regarding at least two drilling parameters, at least one of which is a controllable drilling operational parameter, the received data corresponding to an interval of drilling time;

(b) calculating data-relationship statistics on the temporally evolving received data to identify non-overlapping subintervals of the received data where the subintervals are defined by conditions whereby the received data for the controllable drilling operational parameter of the at least two drilling parameters meets the criteria of having (i) a number of data points within a specified range of number of data points having standard deviations of the controllable drilling operational parameter that is not greater than a specified tolerance for the controllable drilling operational parameter, and (ii) a mean value that is within a specified range for such controllable drilling operational parameter, wherein the subintervals that are defined by such conditions are identified as a response point;

(c) cataloging each identified response point within a response database, including cataloging at least one of a property determined from the received data for the identified response point and a corresponding performance value calculated using the received data for the identified response point;

(d) locating the cataloged response point for the subinterval within a response map;

(e) repeating steps (c)-(d) for each subinterval identified as a response point; and (f) selecting a mapped response point from the response database that meets a selected drilling performance characteristic and using at least one of the cataloged properties of and calculated values for the selected response point as a basis for making an operational adjustment for drilling the wellbore.

2. The method of claim 1, wherein cataloging each identified response point comprises cataloging at least two of a mean value of the received data for the at least one controllable drilling operational parameter within the subinterval, a timestamp of the temporally most recent data within the subinterval, temporal duration of the subinterval, maximum depth drilled within the subinterval, an objective function value calculated from the received data within the subinterval, and another metric calculated from the received data.

3. The method of claim 2, wherein another metric calculated from the received data includes a metric used for at least one of dysfunction detection and drilling performance quantification.

4. The method of claim 1, wherein the at least two drilling operational parameters include at least one of weight on bit (WOB), drillstring rotary speed (RPM), drillstring torque at the rig, drillstring torque at the bit, block position, rate of penetration (ROP), drilling fluid flow rate, pump stroke rate, standpipe pressure, differential pressure across a mud motor, depth-of-cut (DOC), bit friction coefficient, and mechanical specific energy (MSE).

5. The method of claim 1, wherein the at least one controllable drilling operational parameter include at least one of WOB, RPM, drilling fluid flow rate, and pump stroke rate.

6. The method of claim 4, wherein the rate of penetration (ROP) is calculated as the difference between a mean block position of a subset x of the data points in a subinterval and a mean block position of a non-overlapping subset y of the data points in the same subinterval divided by the difference between a mean time of subset x and a mean time of subset y.

7. The method of claim 1, wherein the basis for making operational adjustments for drilling the wellbore is the average or weighted average value of the at least one controllable drilling operational parameter of the response point with a maximum objective function value in the response map.

8. The method of claim 1, wherein the basis for making operational adjustments for drilling the wellbore is the average or weighted average value of the at least one controllable drilling operational parameter of the response point with the minimum objective function value in the response map.

9. The method of claim 1, wherein the basis for making operational adjustments for drilling the wellbore is a specified step size multiplied by a correlation coefficient between an objective function value and at least one controllable drilling operational parameter of a subset of response points in the response database.

10. The method of claim 1, wherein the basis for making operational adjustments for drilling the wellbore is an average or weighted average value of at least one controllable drilling operational parameter of the response point with a maximum objective function value in the response map and a specified step size multiplied by a correlation coefficient between an objective function value and at least one controllable drilling operational parameter of a subset of response points in the response database.

11. The method of claim 1, wherein the basis for making operational adjustments for drilling the wellbore is the average or weighted average value of the at least one controllable drilling operational parameter of the response point with a minimum objective function value in the response map and correlation coefficients of the at least one controllable drilling operational parameter of a subset of response points in the response database.

12. The method of claim 1, wherein the basis for making operational adjustments for drilling the wellbore is the at least one controllable drilling operational parameter of a most recent response point.

13. The method of claim 1, wherein the basis for making operational adjustments for drilling the wellbore is the at least one controllable drilling operational parameter of the response point in the response map with a maximum objective function value.

14. The method of claim 1, wherein the basis for making operational adjustments for drilling the wellbore is the at least one controllable drilling operational parameter of the response point in the response map with a minimum objective function value.

15. The method of claim 1, wherein the basis for making operational adjustments for drilling the wellbore is the at least one controllable drilling operational parameter of the response point in a subset of the response map with a maximum objective function value for the subset.

16. The method of claim 1, wherein the basis for making operational adjustments for drilling the wellbore is the at least one controllable drilling operational parameter of the response point in a subset of the response map with a minimum objective function value for the subset.

17. The method of claim 1, wherein a previous response point in a response map is replaced by a newly created response point that is within specified tolerances of the value(s) of the controllable drilling parameter(s) of that previous response point.

18. The method of claim 17, further comprising calculating a response score based on a mathematical comparison of the number of response points in a response map with a specified threshold number of response points.

19. The method of claim 18, further comprising calculating the response score as the ratio of the number of response points in the response map and a specified threshold number of response points.

20. The method of claim 18, further comprising calculating an objective score using objective function values of the response points in a response map.

21. The method of claim 20, further comprising calculating the objective score by using the product of the response score with the ratio of the objective function value of the most recent response point in a response map and the maximum objective function value in the response map.

22. The method of claim 20, further comprising calculating the objective score by using the product of the response score with the ratio of the objective function value of a subset of received data points and the maximum objective function value in a response map.

23. The method of claim 22, further comprising using decision trees to select a mode of generating recommendations for operational parameters based on whether specified criteria are met for at least one of the response score and the objective score.

24. The method of claim 1, further comprising specifying a selected response map from the response database to be an active response map to determine operational updates to at least one of the at least one controllable drilling parameters.

25. The method of claim 24, further comprising rendering the active response map as inactive and at least one of (i) generating a new response map to be set as the active response map and (ii) setting a previously inactive response map from the response database as the active response map, when specified criteria for at least one of the response score and the objective score are met.

26. The method of claim 24, further comprising rendering the active response map as inactive and at least one of (i) generating a new response map to be set as the active response map and (ii) setting a previously inactive response map from the response database as the active response map, when specified criteria for one or more drilling state variables are met.

27. The method of claim 24, further comprising rendering the active response map as inactive and at least one of (i) generating a new response map to be set as the active response map and (ii) setting a previously inactive response map from the response database as the active response map, when specified criteria for current objective function values relative to previous objective function values are met.

28. The method of claim 1, further comprising temporarily accumulating the received data in a moving window, and wherein at least one of a global search engine and a local search engine use the received data from at least a portion of the moving window.

29. The method of claim 28, further comprising accumulating the data in the interval in a moving window based on at least one of time and depth, wherein window length is determined by frequency of changing the controllable drilling parameters.

30. The method of claim 1, further comprising basing global search engines on a grid search method comprising at least one of 9-point, simplex, golden search, and design of experiments (DOE) methods.

31. The method of claim 30, wherein the grid search method comprises: (1) calculating an objective function from a recorded data set of drilling parameters, where the objective function depends upon at least two controllable drilling parameters; (2) constructing a response surface by regression or interpolation methods from the objective function values, using least squares regression, quadratic interpolation or Delaunay triangulation; (3) finding an optimum value from the response surface; (4) determining the optimized controllable drilling parameter values associated with the optimum value of the response surface.

32. The method of claim 31, wherein the objective function is based on at least one of: rate of penetration (ROP), depth of cut (DOC), mechanical specific energy (MSE), weight on bit (WOB), drillstring rotation rate, bit coefficient of friction (mu), bit rotation rate, torque applied to the drillstring, torque applied to the bit, vibration measurements, hydraulic horsepower, and mathematical combinations thereof.

33. The method of claim 1, wherein a decision tree based on statistical quality metrics is used to select from an application mode and a learning mode to generate an operational recommendation.

34. The method of claim 1, wherein a decision tree based on at least one drilling dysfunction map is used to select from application and learning modes to generate an operational recommendation.

35. The method of claim 33, wherein a decision tree based on a combination of statistical quality metrics and at least one drilling dysfunction map is used to select from application and learning modes to generate the operational recommendation.

36. The method of claim 35, wherein the decision tree selects a learning mode and empties a data window, continues to receive drilling parameter data, recommends controllable drilling parameter values, and calculates statistical quality metrics of the collected data.

37. The method of claim 35, wherein an application mode indicates that the collected data is of sufficient quality to make an operational recommendation.

38. The method of claim 1, further comprising determining operational updates by processing operational recommendations with consideration of the drilling conditions, includes at least one of (1) increase the controllable drilling parameter(s); (2) reduce the controllable drilling parameter(s); (3) maintain the current drilling parameter(s); (4) pick up a drill bit off bottom.

39. The method of claim 1, further comprising after drilling the wellbore, conducting at least one hydrocarbon production-related operation in the wellbore, wherein the at least one hydrocarbon production-related operation comprises at least one of injection operations, treatment operations, and production operations.

40. The method of claim 1, further comprising implementing a determined operational recommendation in a drilling operation substantially automatically.

41. The method of claim 1, further comprising a countdown timer for changing at least one of the controllable drilling parameters.

42. A computer-based system for use in association with drilling operations, the computer-based system comprising:

a processor adapted to execute instructions;

a non-transitory computer readable storage medium in communication with the processor; and at least one instruction set accessible by the processor and saved in the storage medium; wherein the at least one instruction set is adapted to:

(a) receiving temporally evolving data from a drilling system while drilling regarding at least two drilling parameters, at least one of which is a controllable drilling operational parameter, the received data corresponding to an interval of drilling time;

(b) calculating data-relationship statistics on the temporally evolving received data to identify non-overlapping subintervals of the received data where the subintervals are defined by conditions whereby the received data for the controllable drilling operational parameter of the at least two drilling parameters meets the criteria of having (i) a number of data points within a specified range of number of data points have standard deviations of the controllable drilling operational parameter that is not greater than a specified tolerance for the controllable drilling operational parameter, and (ii) a mean value that is within a specified range for such controllable drilling operational parameter, wherein the subintervals that are defined by such conditions are identified as a response point;

(c) cataloging each identified response point within a response database, including cataloging at least one of a property determined from the received data for the identified response point and a corresponding performance value calculated using the received data for the identified response point;

(d) locating the cataloged response point for the subinterval within a response map;

(e) repeating steps (c)-(d) for each subinterval identified as a response point; and (f) selecting a mapped response point from the response database that meets a selected drilling performance characteristic and using at least one of the cataloged properties of and calculated values for the selected response point as a basis for making an operational adjustment for drilling the wellbore.

43. The system of claim 42, further comprising implementing at least one of the determined operational updates in the drilling operations.

44. The system of claim 42, wherein operational updates are exported to a network such that the operational updates are available to other computers.

45. The system of claim 42, wherein operational updates are exported to a control system adapted to implement substantially automatically at least one operational recommendation during the drilling operation.

46. The system of claim 42, further comprising using the system to create a wellbore.

47. The system of claim 46, further comprising using the wellbore in hydrocarbon recovery or production activities.

48. The method of claim 37, further comprising generating the operational recommendation using at least one of a local search engine, a global search engine, and a data fusion method that combines recommendations from a local search engine and a global search engine.

* * * * *